US012686482B2

(12) United States Patent
Kubota et al.

(10) Patent No.: US 12,686,482 B2
(45) Date of Patent: Jul. 21, 2026

(54) WATERCRAFT PROPULSION SYSTEM AND WATERCRAFT

(71) Applicant: YAMAHA HATSUDOKI KABUSHIKI KAISHA, Iwata (JP)

(72) Inventors: Yuta Kubota, Shizuoka (JP); Akihiro Tagata, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 225 days.

(21) Appl. No.: 18/792,648

(22) Filed: Aug. 2, 2024

(65) Prior Publication Data

US 2025/0050998 A1 Feb. 13, 2025

(30) Foreign Application Priority Data

Aug. 10, 2023 (JP) ..... 2023-130680

(51) Int. Cl.
*B63H 25/42* (2006.01)

(52) U.S. Cl.
CPC ..... *B63H 25/42* (2013.01)

(58) Field of Classification Search
CPC ..... B63H 25/42; B63H 25/04; B63H 20/08; G05D 1/0503
See application file for complete search history.

(56) References Cited

U.S. PATENT DOCUMENTS 7,601,040 B2 * 10/2009 Morvillo ..... B63H 21/22 440/38
7,818,108 B2 * 10/2010 Bertazzoni ..... B63H 25/42 701/44
7,883,383 B2 * 2/2011 Larsson ..... G05D 1/0206 440/1
9,988,134 B1 * 6/2018 Gable ..... B63B 79/40
(Continued)

FOREIGN PATENT DOCUMENTS

EP 3434581 A1 * 1/2019 ..... B63H 25/02
EP 3437986 A1 * 2/2019 ..... B63H 5/08
(Continued)

OTHER PUBLICATIONS

Official Communication issued in corresponding European Patent Application No. 24192074.3, mailed on Feb. 17, 2025, 7 pages.

*Primary Examiner* — Marc Q Jimenez
*Assistant Examiner* — Jovon E Hayes
(74) *Attorney, Agent, or Firm* — Keating & Bennett, LLP

(57) ABSTRACT

A watercraft propulsion system includes a bow thruster to generate a propulsive force laterally of the hull, a propulsion device to generate a propulsive force anteroposteriorly of the hull, a steering to change the course of the hull, and a controller configured or programmed to control the bow thruster, the propulsion device, and the steering in response to a diagonal movement command to control an output of the bow thruster, the propulsive force generated by the propulsion device, and the steering angle of the steering. The
(Continued)

1 controller includes a calibration mode in which a calibration value to be used to control the bow thruster, the propulsion device, and the steering according to the diagonal movement command is set. The controller is configured or programmed to increase the output of the bow thruster if a bow turning promotion command is issued together with the diagonal movement command in the calibration mode.

11 Claims, 11 Drawing Sheets

(56) References Cited

U.S. PATENT DOCUMENTS

| | | | | |
|---|---|---|---|---|
| 11,372,412 | B1 * | 6/2022 | Yamaguchi | B63H 20/12 |
| 2009/0076671 | A1 | 3/2009 | Mizutani | |
| 2010/0022146 | A1 * | 1/2010 | Morvillo | B63H 21/22 440/84 |
| 2014/0046515 | A1 * | 2/2014 | Mizutani | B63H 20/08 701/21 |
| 2016/0096611 | A1 | 4/2016 | Suzuki et al. | |
| 2017/0305520 | A1 * | 10/2017 | Watanabe | B63H 25/42 |
| 2019/0112021 | A1 * | 4/2019 | Watanabe | B63H 5/08 |
| 2020/0331578 | A1 * | 10/2020 | Sakashita | B63H 5/125 |
| 2025/0050999 | A1 * | 2/2025 | Moromi | B63H 20/00 |

FOREIGN PATENT DOCUMENTS

| | | | | | |
|---|---|---|---|---|---|
| JP | 2008184127 | A | * | 8/2008 | |
| JP | 2013014173 | A | * | 1/2013 | |
| JP | 2016074250 | A | | 5/2016 | |
| JP | 2020168921 | A | | 10/2020 | |
| JP | 2024068486 | A | * | 5/2024 | B63H 25/46 |
| WO | WO-2020069750 | A1 | * | 4/2020 | G05D 1/0206 |

* cited by examiner

WATERCRAFT PROPULSION SYSTEM AND WATERCRAFT

CROSS REFERENCE TO RELATED APPLICATIONS

This application claims the benefit of priority to Japanese Patent Application No. 2023-130680 filed on Aug. 10, 2023. The entire contents of this application are hereby incorporated herein by reference.

BACKGROUND OF THE INVENTION

1. Field of the Invention

The present invention relates to watercraft propulsion systems, and watercraft including the watercraft propulsion systems.

2. Description of the Related Art

US 2014/0046515 A1 discloses a watercraft propulsion control system for a watercraft including a bow thruster and a single outboard motor. In the watercraft propulsion control system, a watercraft maneuvering pattern is preliminarily selected and defined for an operation state of a lever (joystick) provided on a joystick unit. Specifically, watercraft maneuvering patterns for bow turning involving arcuate movement, diagonally forward translation, diagonally rearward translation, fixed-point bow turning, and lateral translation are selectable for lateral tilt operation of the joystick. A watercraft maneuvering pattern for anteroposterior movement is solely selected for anteroposterior tilt operation of the joystick.

It is stated that, where the joystick is tilted diagonally, a watercraft maneuvering pattern may be obtained by combining the watercraft maneuvering pattern selected for the anteroposterior tilt operation of the joystick with any one of the watercraft maneuvering patterns selected for the lateral tilt operation of the joystick. More specifically, it is stated that the tilt amount of the joystick is broken down into an anteroposterior component and a lateral component, and that the magnitude of the propulsive force of the outboard motor may be determined according to the anteroposterior component and the magnitude of the propulsive force of the bow thruster may be determined according to the lateral component.

SUMMARY OF THE INVENTION

The inventor of example embodiments of the present invention described and claimed in the present application conducted an extensive study and research regarding a watercraft propulsion system, such as the one described above, and in doing so, discovered and first recognized new unique challenges and previously unrecognized possibilities for improvements as described in greater detail below.

Boat builders build watercrafts by selecting hulls and watercraft devices according to the demands of individual customers, so that the resulting watercrafts individually have different constructions. Specifically, the watercrafts vary in the size and the shape of a hull, the model and the attachment position of a bow thruster on the hull, and the model and the attachment position of a propulsion device (an outboard motor or the like). Therefore, how the propulsive forces of the bow thruster and the propulsion device (the outboard motor or the like) act on the hull varies depending on the watercrafts. Accordingly, calibration is required for the adjustment of the individual watercrafts. In US 2014/0046515 A1, no description is found on such calibration and, therefore, consideration is still needed.

Example embodiments of the present invention provide watercraft propulsion systems each including structure to calibrate a diagonal movement command, and watercraft including the watercraft propulsion systems.

In order to overcome the previously unrecognized and unsolved challenges described above, an example embodiment of the present invention provides a watercraft propulsion system including a bow thruster at the bow of a hull to generate a propulsive force laterally of the hull, a propulsion device on the hull to generate a propulsive force anteroposteriorly of the hull, and a steering to change the course of the hull. The watercraft propulsion system further includes a controller configured or programmed to control the bow thruster, the propulsion device, and the steering in response to a diagonal movement command to control an output (propulsive force) of the bow thruster, the propulsive force generated by the propulsion device, and the steering angle of the steering. The controller is configured or programmed to include a calibration mode in which a calibration value (control reference value) to be used to control the bow thruster, the propulsion device, and the steering according to the diagonal movement command is set. The controller is configured or programmed to increase the output of the bow thruster if a bow turning promotion command that causes bow turning in a movement direction indicated by the diagonal movement command is issued together with the diagonal movement command in the calibration mode. The controller is configured or programmed to reduce the propulsive force of the propulsion device even if the output of the bow thruster reaches its upper limit when the bow turning promotion command is issued.

With this arrangement, the watercraft propulsion system is able to be calibrated for the diagonal movement command. For the bow turning promotion command issued during the calibration, the output of the bow thruster is first increased, and then the propulsive force of the propulsion device is reduced. Therefore, the calibration is performed so as to increase the propulsive force of the propulsion device as much as possible. Thus, the overall propulsive force to be utilized for the diagonal movement is increased as much as possible.

In an example embodiment of the present invention, the controller is configured or programmed to reduce an absolute value of the steering angle of the steering even if the propulsive force of the propulsion device is reduced to its lower limit when the bow turning promotion command is issued in the calibration mode.

With this arrangement, if the propulsive force of the propulsion device is reduced to its lower limit, then the absolute value of the steering angle of the steering is reduced. Therefore, the calibration is performed so as to increase the absolute value of the steering angle as much as possible. Thus, the lateral component of the propulsive force generated by the propulsion device is increased as much as possible. Accordingly, the calibration is performed so as to increase the overall propulsive force to be utilized for the diagonal movement as much as possible.

In an example embodiment of the present invention, the controller is configured or programmed to increase the absolute value of the steering angle of the steering if a bow turning suppression command that causes bow turning in a direction opposite to the movement direction indicated by the diagonal movement command is issued together with the diagonal movement command in the calibration mode. The controller is configured or programmed to increase the propulsive force of the propulsion device even if the absolute value of the steering angle reaches its upper limit when the bow turning suppression command is issued in the calibration mode. The controller is configured or programmed to reduce the output of the bow thruster even if the propulsive force of the propulsion device reaches its upper limit when the bow turning suppression command is issued in the calibration mode.

With this arrangement, for the bow turning suppression command issued during the calibration, the absolute value of the steering angle of the steering is first increased, and then the propulsive force of the propulsion device is increased. Thereafter, the output of the bow thruster is reduced. Thus, the calibration is performed so as to increase the absolute value of the steering angle as much as possible and to increase the propulsive force of the propulsion device as much as possible. Thus, the propulsive force of the propulsion device (particularly, the lateral component of the propulsive force of the propulsion device) is increased as much as possible. Accordingly, the calibration is performed so as to increase the overall propulsive force to be utilized for the diagonal movement as much as possible.

In an example embodiment of the present invention, the calibration value includes a calibration value of a ratio between the lateral component of the propulsive force of the propulsion device and the output of the bow thruster, and a calibration value of the steering angle of the steering.

The controller is able to determine the propulsive force of the propulsion device, for example, based on the diagonal movement command, and is able to determine the lateral component of the propulsive force based on the determined propulsive force and the calibration value of the steering angle. Further, the controller is able to determine the output of the bow thruster by multiplying the determined lateral component by the calibration value of the ratio.

In an example embodiment of the present invention, the calibration value further includes a calibration value of the maximum value of the propulsive force generated by the propulsion device. The controller is able to determine the calibration value of the maximum value of the propulsive force of the propulsion device, for example, based on the upper limit value of the output of the bow thruster, and the calibration values of the ratio and the steering angle. This value corresponds to a propulsive force generated by the propulsion device to generate a bow turning moment to prevent the bow turning of the hull against a bow turning moment generated by the propulsive force of the bow thruster when the output of the bow thruster is its upper limit value.

In an example embodiment of the present invention, the calibration value includes calibration values for a diagonally forward-right movement command, a diagonally rearward-right movement command, a diagonally forward-left movement command, and a diagonally rearward-left movement command. By separately providing the calibration values for diagonal movements in four diagonal directions, the hull is accurately moved in any of the diagonal directions according to the corresponding diagonal movement command.

In an example embodiment of the present invention, the controller is configured or programmed to set a calibration value for at least one of the diagonally forward-right movement command, the diagonally rearward-right movement command, the diagonally forward-left movement command, and the diagonally rearward-left movement command, and compute calibration values yet to be set for the other diagonal movement commands based on the calibration value thus set.

With this arrangement, upon completion of the calibration for any of the diagonal movements, the calibration values for the other uncalibrated diagonal movements are automatically computed. Thus, there is no need to perform the calibration for all diagonal movements. Further, if a substantially reasonable calibration value is set for any of the diagonal movements, the calibration is easily performed for the other uncalibrated diagonal movements to provide more accurate calibration values.

In an example embodiment of the present invention, the watercraft propulsion system further includes a calibration ending operator operable by a calibrating person to end the calibration mode. The controller is configured or programmed to generate the calibration value based on the control states of the bow thruster, the propulsion device, and the steering observed when the calibration ending operator is operated, and store the calibration value in a memory. In response to the diagonal movement command, a control operation is performed by utilizing the calibration value thus stored in the memory.

In an example embodiment of the present invention, the propulsion device includes only one single propulsion device on the stern of the hull, or a plurality of propulsion devices on the stern of the hull and steerable at the same steering angle.

A combination of the plurality of propulsion devices configured to be steered at the same steering angle is equivalent to the single propulsion device in that the propulsive forces of the respective propulsion devices are applied in the same direction to the hull but are not simultaneously applied in different directions to the hull. In the watercraft propulsion system including the bow thruster at the bow of the hull and the propulsion devices on the stern of the hull and incapable of simultaneously applying their propulsive forces in different directions to the hull, the calibration is performed for the diagonal movement command. Thus, a hull behavior is achieved by properly actuating the bow thruster, the propulsion devices, and the steering in proper response to the diagonal movement command.

In an example embodiment of the present invention, the bow thruster is fixed to the hull in an unsteerable manner.

Another example embodiment of the present invention provides a watercraft including a hull and a watercraft propulsion system having any of the features described above.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
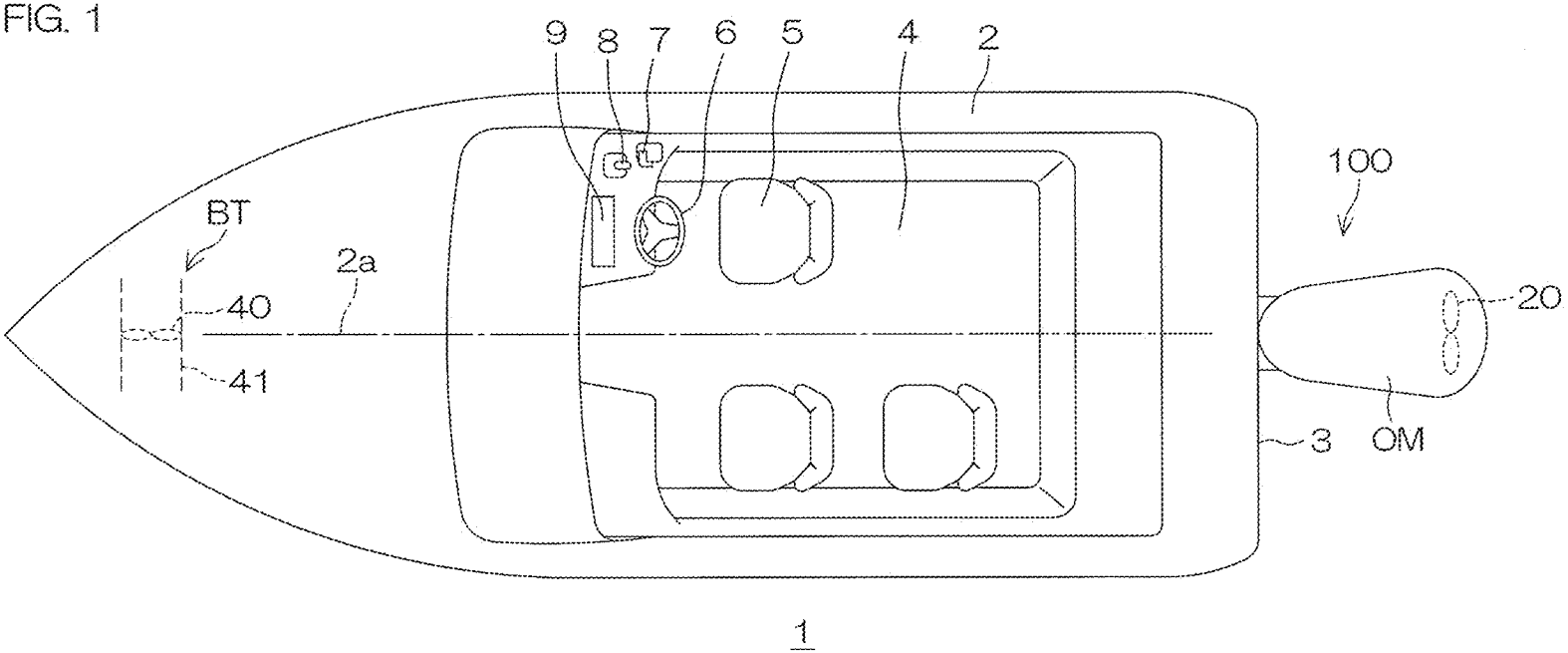
FIG. 1 is a plan view showing an exemplary construction of a watercraft mounted with a watercraft propulsion system according to an example embodiment of the present invention.

FIG. 1 is a plan view showing an exemplary construction of a watercraft 1 mounted with a watercraft propulsion system 100 according to an example embodiment of the present invention. The watercraft 1 includes a hull 2, a bow thruster BT provided at the bow of the hull 2 to generate a lateral propulsive force, and an outboard motor OM (an example of the propulsion device) provided on the stern 3 of the hull 2 and having a variable steering angle. In the present example embodiment, the single outboard motor OM is provided on a center line 2*a* extending anteroposteriorly of the hull 2 by way of example, but a plurality of outboard motors OM, more specifically, two or more outboard motors OM, may be provided on the stern 3.

The outboard motor OM includes a propeller 20 located underwater, and is configured to generate a propulsive force by the rotation of the propeller 20 and apply the propulsive force to the hull 2. The outboard motor OM is attached to the stern 3 pivotably leftward and rightward such that the direction of the propulsive force generated by the propeller 20 is changed leftward and rightward. The steering angle is defined, for example, as an angle between the direction of the propulsive force generated by the propeller 20 and an anteroposterior reference direction parallel to the center line 2*a*. The outboard motor OM is configured to be pivoted leftward and rightward by a steering mechanism 26 thereof (see FIG. 2) to change the steering angle. When the propulsive force direction is parallel to the anteroposterior direction, the steering angle is zero. When the rear end of the outboard motor OM is directed rightward, the steering angle may be expressed with a positive sign. When the rear end of the outboard motor OM is directed leftward, the steering angle may be expressed with a negative sign.

The bow thruster BT includes a propeller 40 disposed in a tubular tunnel 41 extending through the bow portion of the hull 2 transversely of the hull 2. The propeller 40 may include, for example, two propellers connected to the opposite ends of its rotation shaft. The propeller 40 is rotatable in a forward rotation direction and a reverse rotation direction, i.e., is bidirectionally rotatable such that the bow thruster BT is able to apply a rightward or leftward propulsive force to the hull 2. In the present example embodiment, the direction of the propulsive force to be generated by the bow thruster BT is not settable to a direction other than the rightward direction and the leftward direction. That is, the bow thruster BT is fixed to the hull 2 in an unsteerable manner in the present example embodiment.

A usable space 4 for passengers is provided inside the hull 2. A helm seat 5 is provided in the usable space 4. A steering wheel 6, a remote control lever 7, a joystick 8, a gauge 9 (display panel) and the like are provided in association with the helm seat 5. The steering wheel 6 is an operator to be operated by a user to change the course of the watercraft 1. The remote control lever 7 is an operator to be operated by the user to change the magnitude (output) and the direction (a forward or reverse direction) of the propulsive force of the outboard motor OM, and corresponds to an acceleration operator. The joystick 8 is an operator to be operated instead of the steering wheel 6 and the remote control lever 7 by the user for watercraft maneuvering. An operator 45 (see FIG. 2) dedicated for the operation of the bow thruster BT may be provided in addition to the aforementioned operators.

Figure 2:
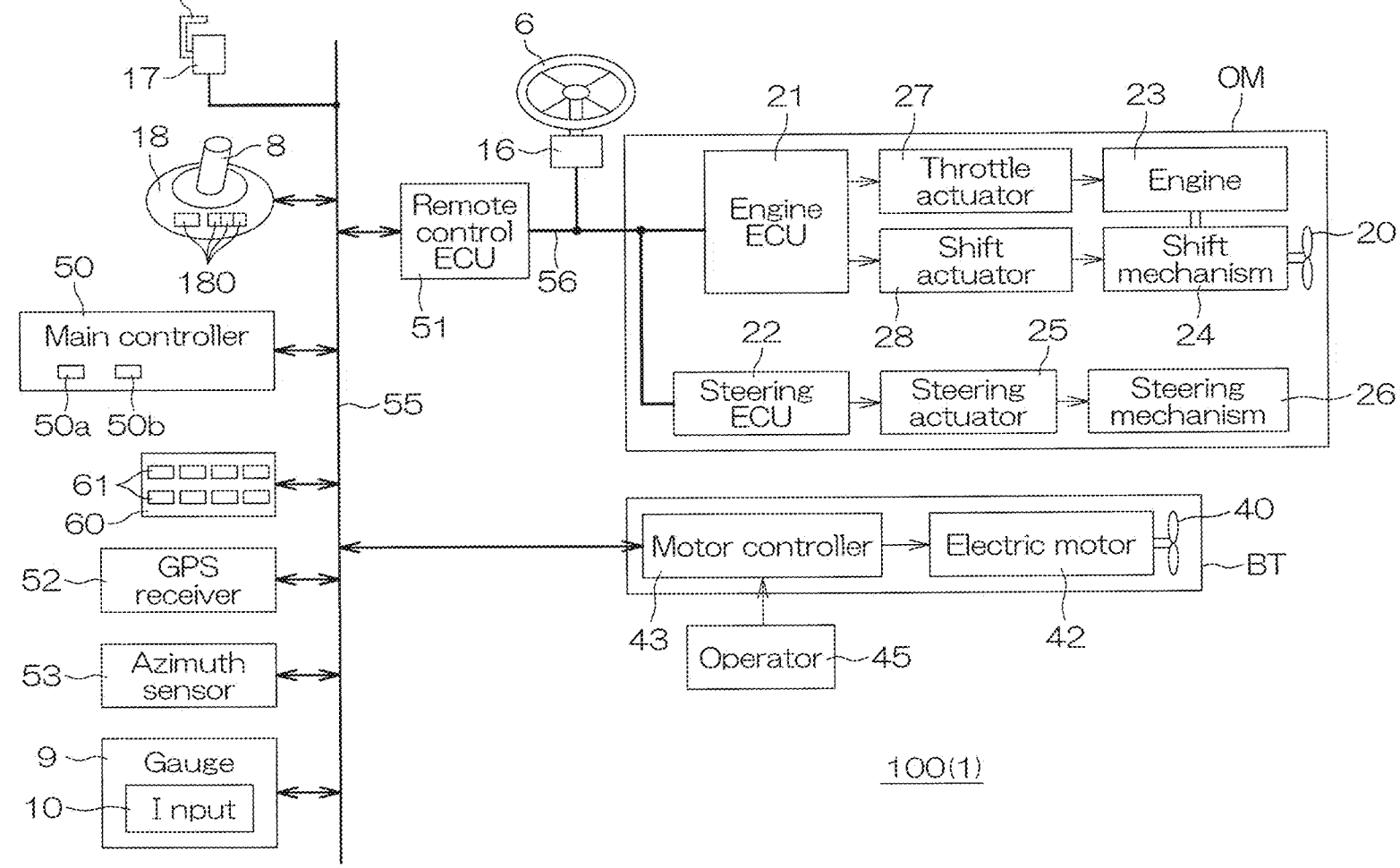
FIG. 2 is a block diagram showing the configuration of the watercraft propulsion system by way of example.

FIG. 2 is a block diagram showing the configuration of the watercraft propulsion system 100 provided in the watercraft 1 by way of example. The watercraft propulsion system 100 includes the outboard motor OM and the bow thruster BT. The outboard motor OM may be an engine outboard motor or an electric outboard motor. In FIG. 2, the engine outboard motor is illustrated as the outboard motor OM by way of example.

The outboard motor OM includes an engine ECU (Electronic Control Unit) 21, a steering ECU 22, an engine 23, a shift mechanism 24, the propeller 20, the steering mechanism 26 and the like. Power generated by the engine 23 is transmitted to the propeller 20 via the shift mechanism 24. The steering mechanism 26 is configured to pivot the body of the outboard motor OM leftward and rightward with respect to the hull 2 (see FIG. 1) to change the direction of the propulsive force generated by the outboard motor OM leftward and rightward. The shift mechanism 24 is configured to select a shift position from a forward shift position, a reverse shift position, and a neutral shift position. With the shift position set to the forward shift position, the propeller 20 is rotated in a forward rotation direction by the transmission of the rotation of the engine 23 such that the outboard motor OM is brought into a forward drive state to generate a forward propulsive force. With the shift position set to the reverse shift position, the propeller 20 is rotated in a reverse rotation direction by the transmission of the rotation of the engine 23 such that the outboard motor OM is brought into a reverse drive state to generate a reverse propulsive force. With the shift position set to the neutral shift position, the power transmission between the engine 23 and the propeller 20 is interrupted such that the outboard motor OM is brought into an idling state.

The outboard motor OM further includes a throttle actuator 27 and a shift actuator 28, which are controlled by the engine ECU 21. The throttle actuator 27 is an electric actuator (typically including an electric motor) that actuates the throttle valve (not shown) of the engine 23. The shift actuator 28 is an actuator that actuates the shift mechanism 24. The outboard motor OM further includes a steering actuator 25 to be controlled by the steering ECU 22. The steering actuator 25 is the drive source of the steering mechanism 26, and typically includes an electric motor. The steering actuator 25 may include a hydraulic device of an electric pump type. The steering actuator 25 and the steering mechanism 26 are a non-limiting example of the steering that changes the course of the hull 2.

The bow thruster BT includes the propeller 40, an electric motor 42 that drives the propeller 40, and a motor controller 43 that controls the electric motor 42.

The watercraft propulsion system 100 further includes a main controller 50. The main controller 50 includes a processor 50*a* and a memory 50*b*, and is configured so that the processor 50*a* executes a program stored in the memory 50*b* to perform a plurality of functions. The main controller 50 is connected to an onboard network 55 (CAN: Control Area Network) provided in the hull 2. A remote control unit 17, a remote control ECU 51, a joystick unit 18, a GPS (Global Positioning System) receiver 52, an azimuth sensor 53 and the like are connected to the onboard network 55.

The remote control ECU 51 for the outboard motor OM is connected to the onboard network 55. The engine ECU 21 and the steering ECU 22 of the outboard motor OM are connected to the remote control ECU 51 via an outboard motor control network 56. The main controller 50 transmits and receives signals to/from various units connected to the onboard network 55 to control the outboard motor OM and the bow thruster BT, and further controls other units. The main controller 50 includes a plurality of control modes, and controls the units in predetermined manners according to the respective control modes.

A steering wheel unit 16 is connected to the outboard motor control network 56. The steering wheel unit 16 outputs an operation angle signal indicating the operation angle of the steering wheel 6 to the outboard motor control network 56. The operation angle signal is received by the remote control ECU 51 and the steering ECU 22. In response to the operation angle signal generated by the steering wheel unit 16 or a steering angle command generated by the remote control ECU 51, the steering ECU 22 correspondingly controls the steering actuator 25 to control the steering angle of the outboard motor OM.

The remote control unit 17 generates an operation position signal indicating the operation position of the remote control lever 7.

The joystick unit 18 generates an operation position signal indicating the operation position of the joystick 8, and generates an operation signal indicating the operation of any of operation buttons 180 provided in the joystick unit 18.

The remote control ECU 51 outputs a propulsive force command to the engine ECU 21 via the outboard motor control network 56. The propulsive force command includes a shift command indicating the shift position, and an output command indicating an engine output (specifically, an engine speed). Further, the remote control ECU 51 outputs the steering angle command to the steering ECU 22 via the outboard motor control network 56. The steering ECU 22 receives the detection signal of a steering angle sensor (not shown) that detects the steering angle of the steering mechanism 26. The steering ECU 22 controls the steering actuator 25 so that the actual steering angle detected by the steering angle sensor matches with the steering angle command issued from the remote control ECU 51. The actual steering angle detected by the steering angle sensor is transmitted to the remote control ECU 51 from the steering ECU 22, and further transmitted to the main controller 50 from the remote control ECU 51.

The remote control ECU 51 performs different control operations according to different control modes of the main controller 50. In a control mode for watercraft maneuvering with the use of the steering wheel 6 and the remote control lever 7, for example, the remote control ECU 51 generates the propulsive force command (the shift command and the output command) according to the operation position signal generated by the remote control unit 17, and applies the propulsive force command (the shift command and the output command) to the engine ECU 21. Further, the remote control ECU 51 commands the steering ECU 22 to conform to the operation angle signal generated by the steering wheel unit 16. In a control mode for watercraft maneuvering without the use of the steering wheel 6 and the remote control lever 7, on the other hand, the remote control ECU 51 conforms to commands issued by the main controller 50. That is, the main controller 50 generates the propulsive force command (the shift command and the output command) and the steering angle command, and the remote control ECU 51 outputs the propulsive force command (the shift command and the output command) and the steering angle command to the engine ECU 21 and the steering ECU 22, respectively. In a control mode for watercraft maneuvering with the use of the joystick 8 (joystick mode), for example, the main controller 50 generates the propulsive force command (the shift command and the output command) and the steering angle command according to the signals generated by the joystick unit 18. The magnitude and the direction (the forward direction or the reverse direction) of the propulsive force and the steering angle of the outboard motor OM are controlled according to the propulsive force command (the shift command and the output command) and the steering angle command thus generated.

The engine ECU 21 drives the shift actuator 28 according to the shift command to control the shift position, and drives the throttle actuator 27 according to the output command to control the throttle opening degree of the engine 23. The steering ECU 22 controls the steering actuator 25 according to the steering angle command to control the steering angle of the outboard motor OM.

The motor controller 43 of the bow thruster BT is connected to the onboard network 55, and is configured to actuate the electric motor 42 in response to a command issued from the main controller 50. The motor controller 43 may be connected to the onboard network 55 via a gateway (not shown). The main controller 50 issues a propulsive force command to the motor controller 43. The propulsive force command includes a shift command (rotation direction command) and an output command (rotation speed command). The shift command is a rotation direction command that causes the stop, the forward rotation, or the reverse rotation of the propeller 40. The output command is a rotation speed command that causes a propulsive force to be generated, specifically, a target rotation speed value. The motor controller 43 controls the rotation direction and the rotation speed of the electric motor 42 according to the shift command (rotation direction command) and the output command.

In the present example, the operator 45 dedicated for the bow thruster BT is connected to the motor controller 43. The user is able to adjust the rotation direction and the rotation speed of the bow thruster BT by operating the operator 45.

The GPS receiver 52 is an exemplary position detection device. The GPS receiver 52 detects the position of the watercraft 1 by receiving radio waves from an artificial satellite orbiting the earth, and outputs position data indicating the position of the watercraft 1 and speed data indicating the moving speed of the watercraft 1. The main controller 50 acquires the position data and the speed data, which are used to control and display the position and/or the azimuth of the watercraft 1. GPS is a specific example of GNSS (Global Navigation Satellite System).

The azimuth sensor 53 detects the azimuth of the watercraft 1 to generate azimuth data, which is used by the main controller 50.

The gauge 9 is connected to the onboard network 55. The gauge 9 is a display device that displays various information for the watercraft maneuvering. The gauge 9 is able to communicate, for example, with the main controller 50, the remote control ECU 51, and the motor controller 43. Thus, the gauge 9 is able to display the operation state of the outboard motor OM, the operation state of the bow thruster BT, the position and/or the azimuth of the watercraft 1, and other information. The gauge 9 may include an input device 10 such as a touch panel and buttons. The input device 10 may be operated by the user to set various settings and give various commands such that operation signals are outputted to the onboard network 55. An additional network other than the onboard network 55 may be provided to transmit display control signals related to the gauge 9.

Further, an application switch panel 60 is connected to the onboard network 55. The application switch panel 60 includes a plurality of function switches 61 to be operated to issue predefined function commands. For example, the function switches 61 may include switches for automatic watercraft maneuvering commands. More specifically, a command for a bow holding mode (Heading Hold) in which an automatic steering operation is performed to maintain the bow azimuth during forward sailing may be assigned to one of the function switches 61, and a command for a straight sailing holding mode (Course Hold) in which an automatic steering operation is performed to maintain the bow azimuth and a straight course during forward sailing may be assigned to another of the function switches 61. Further, a command for a checkpoint following mode (Track Point™) in which an automatic steering operation is performed to follow a course (route) passing through specified checkpoints may be assigned to further another of the function switches 61, and a command for a pattern sailing mode (Pattern Steer) in which an automatic steering operation is performed to follow a predetermined sailing pattern (zig-zag pattern, spiral pattern or the like) may be assigned to still another of the function switches 61.

Figure 3:
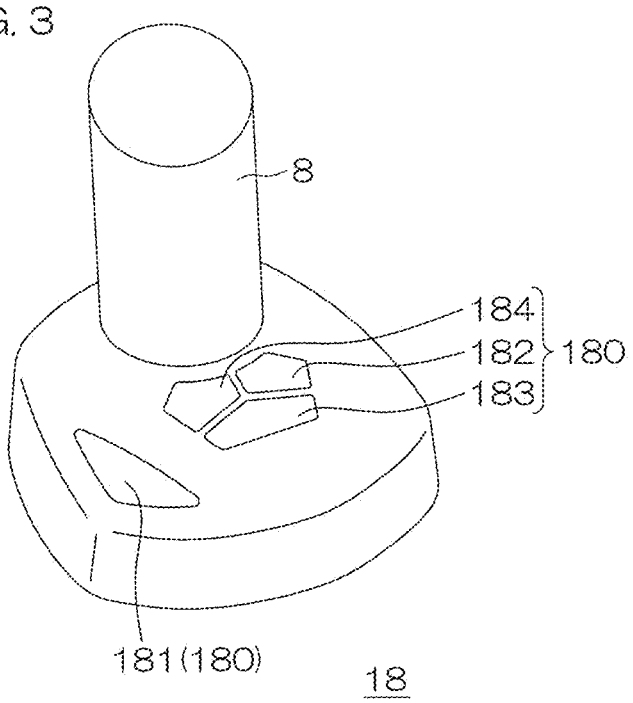
FIG. 3 is a perspective view showing the structure of a joystick unit by way of example.

FIG. 3 is a perspective view showing the structure of the joystick unit 18 by way of example. The joystick unit 18 includes the joystick 8, which is tiltable forward, backward, leftward, and rightward (i.e., in all 360-degree directions) from its neutral tilt position, and is twistable or pivotable leftward and rightward from its neutral twist position about its axis. In the present example, the joystick unit 18 further includes the operation buttons 180. The operation buttons 180 include a joystick button 181 and holding mode setting buttons 182 to 184.

The joystick button 181 is an operator to be operated by a user (watercraft operator) to select a control mode (watercraft maneuvering mode) utilizing the joystick 8, i.e., the joystick mode.

The holding mode setting buttons 182, 183, 184 are operation buttons to be operated by the user to select position/azimuth holding control modes (examples of an automatic watercraft maneuvering mode). More specifically, the holding mode setting button 182 is operated to select a fixed-point holding mode (Stay Point™) in which the position and the bow azimuth (or the stern azimuth) of the watercraft 1 are maintained. The holding mode setting button 183 is operated to select a position holding mode (Fish Point™) in which the position of the watercraft 1 is maintained but the bow azimuth (or the stern azimuth) of the watercraft 1 is not maintained. The holding mode setting button 184 is operated to select an azimuth holding mode (Drift Point™) in which the bow azimuth (or the stern azimuth) of the watercraft 1 is maintained but the position of the watercraft 1 is not maintained.

The control mode of the main controller 50 is classified into an ordinary mode, the joystick mode, or the automatic watercraft maneuvering mode in terms of the operation system.

In the ordinary mode, a steering control operation is performed according to the operation angle signal generated by the steering wheel unit 16, and a propulsive force control operation is performed according to the operation signal (operation position signal) of the remote control lever 7. In the present example embodiment, the ordinary mode is a default control mode of the main controller 50. In the steering control operation, specifically, the steering ECU 22 drives the steering actuator 25 according to the operation angle signal generated by the steering wheel unit 16 or the steering angle command generated by the remote control ECU 51. Thus, the body of the outboard motor OM is steered leftward and rightward such that the propulsive force direction is changed leftward and rightward with respect to the hull 2. In the propulsive force control operation, specifically, the engine ECU 21 drives the shift actuator 28 and the throttle actuator 27 according to the propulsive force command (the shift command and the output command) issued from the remote control ECU 51 to the engine ECU 21. Thus, the shift position of the outboard motor OM is set to the forward shift position, the reverse shift position, or the neutral shift position, and the engine output (specifically, the engine speed) of the outboard motor OM is changed.

In the joystick mode, the steering control operation and the propulsive force control operation are performed according to the operation signal of the joystick 8 of the joystick unit 18.

In the joystick mode, the steering control operation and the propulsive force control operation are performed on the outboard motor OM. That is, the main controller 50 applies the steering angle command and the propulsive force command to the remote control ECU 51, and the remote control ECU 51 applies the steering angle command and the propulsive force command to the steering ECU 22 and the engine ECU 21, respectively.

In the automatic watercraft maneuvering mode, the steering control operation and/or the propulsive force control operation are automatically performed by the functions of the main controller 50 and the like without the operation of the steering wheel 6, the remote control lever 7, and the joystick 8. That is, an automatic watercraft maneuvering operation is performed. The automatic watercraft maneuvering operation includes an automatic watercraft maneuvering operation to be performed on a sailing basis during sailing, and an automatic watercraft maneuvering operation on a position/azimuth holding basis to maintain one or both of the position and the azimuth. Examples of the automatic watercraft maneuvering operation on the sailing basis include the automatic steering operations to be selected by operating the function switches 61. Examples of the automatic watercraft maneuvering operation on the position/azimuth holding basis include watercraft maneuvering operations to be performed in the fixed-point holding mode, the position holding mode, and the azimuth holding mode, which are respectively selected by operating the holding mode setting buttons 182, 183, and 184.

In the present example embodiment, a cooperative mode in which the outboard motor OM and the bow thruster BT cooperate to achieve an intended hull behavior or a non-cooperative mode in which the outboard motor OM and the bow thruster BT do not cooperate are selectable in the joystick mode and the automatic watercraft maneuvering mode. A selection operator operable by the user to select the cooperative mode or the non-cooperative mode, for example, may be assigned to any of the function switches 61 provided on the application switch panel 60. Alternatively, the selection of the cooperative mode or the non-cooperative mode may be achieved by operating the input device 10 of the gauge 9. In the cooperative mode, the main controller 50 performs the steering control operation and the propulsive force control operation on the outboard motor OM and, in addition, performs the propulsive force control operation on the bow thruster BT.

Figure 4:
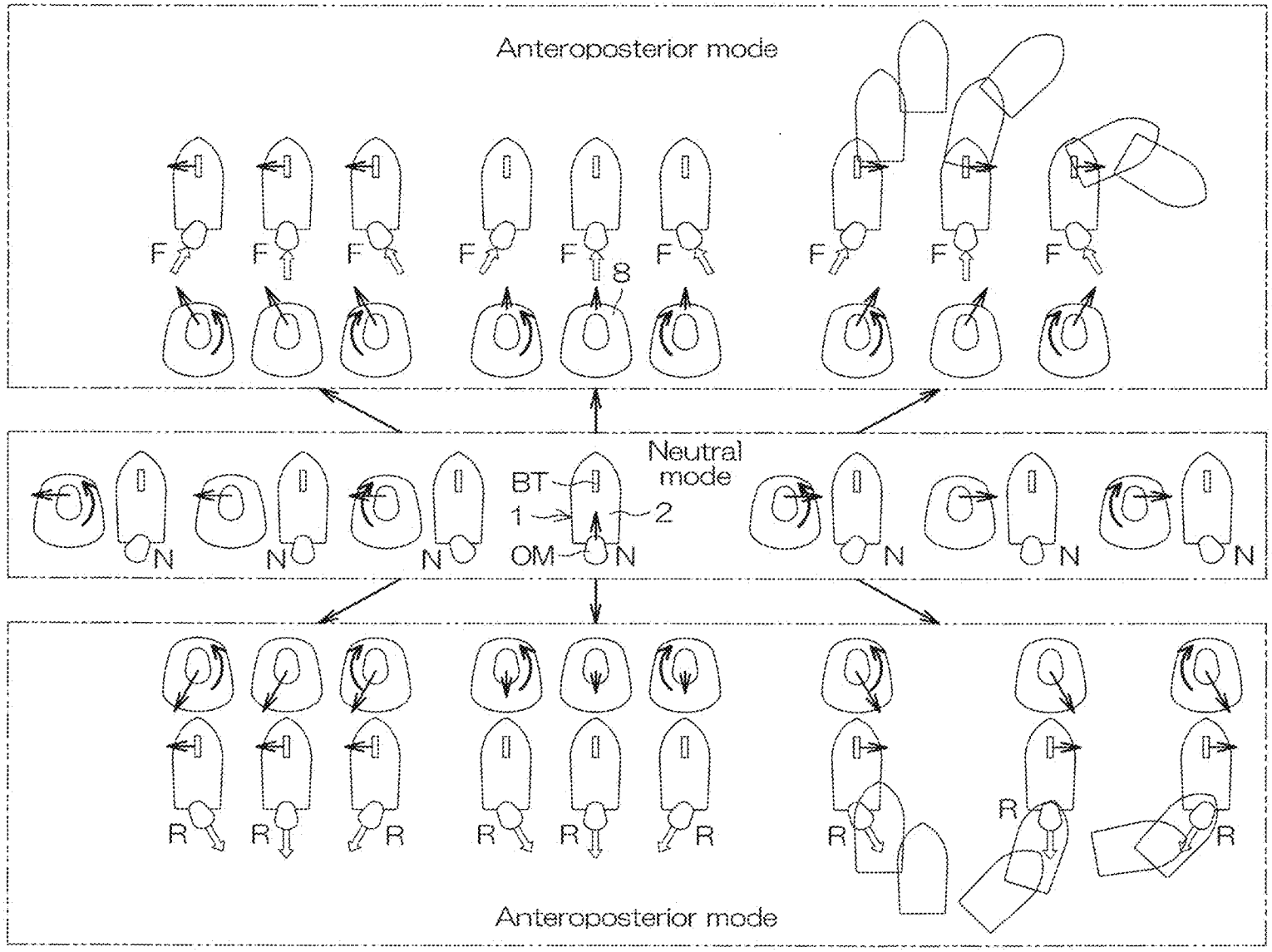
FIG. 4 is a diagram for describing a neutral mode and an anteroposterior mode, which are sub-modes of a first joystick mode.
Figure 5:
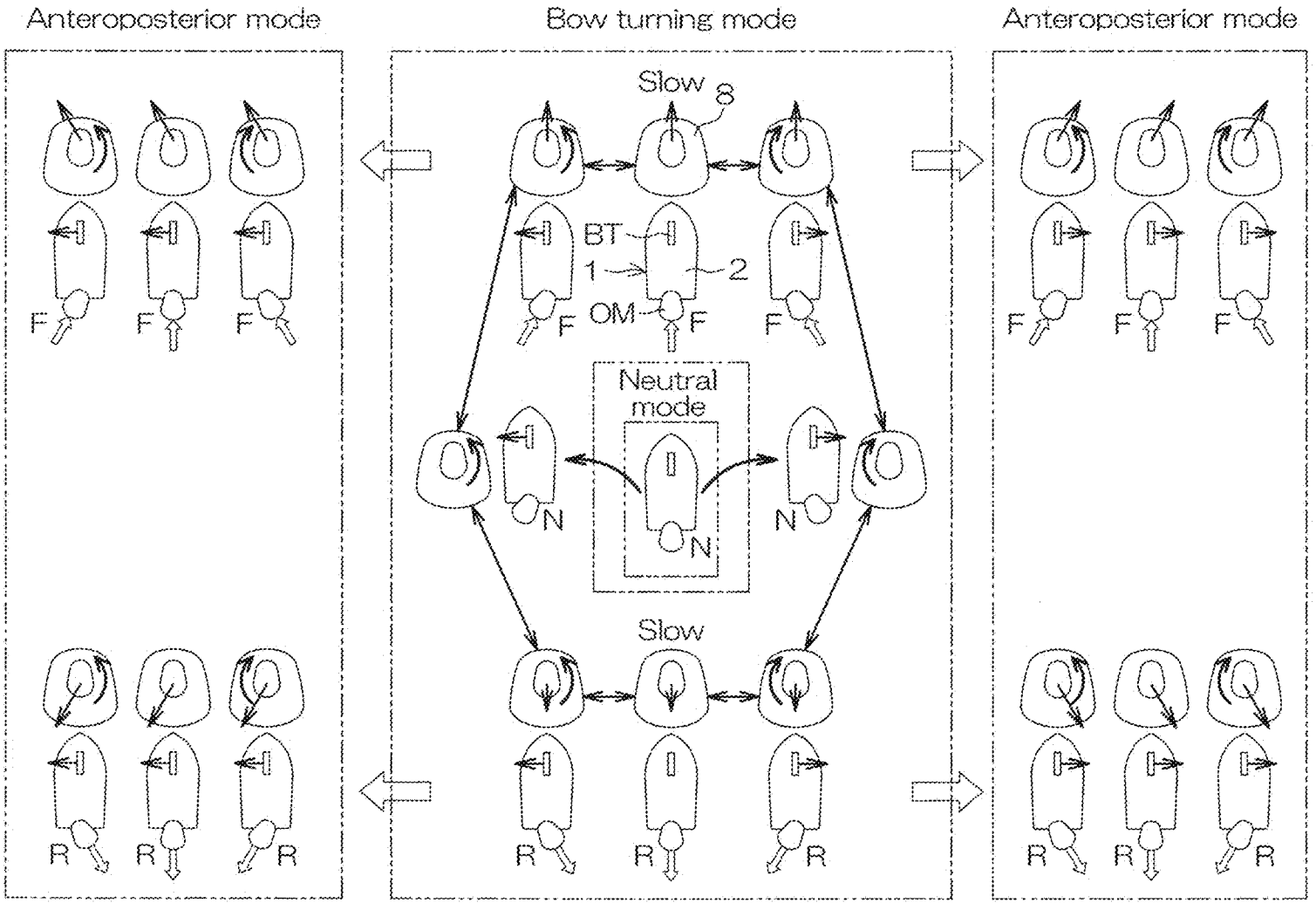
FIG. 5 is a diagram for describing the neutral mode and a bow turning mode, which are sub-modes of the first joystick mode.

FIGS. 4 and 5 are diagrams for describing a first joystick mode in the cooperative mode, showing the operation states of the joystick 8 and the corresponding behaviors of the hull 2. In the first joystick mode, the main controller 50 includes a plurality of sub-modes (control modes) including a neutral mode in which no propulsive force is applied to the hull 2, a bow turning mode in which the bow of the hull 2 is turned, and an anteroposterior mode in which the hull 2 is anteroposteriorly moved. When the joystick 8 is in the neutral tilt position and the neutral twist position, the main controller 50 is in the neutral mode. In the neutral mode, the main controller 50 controls the propulsive force of the bow thruster BT to zero, sets the shift position of the outboard motor OM to the neutral shift position N, and controls the steering angle of the outboard motor OM to zero. When the joystick 8 is tilted from the neutral tilt position in the neutral twist position, the main controller 50 is switched from the neutral mode to the anteroposterior mode. This operation is shown in FIG. 4. Further, when the joystick 8 is twisted from the neutral twist position in the neutral tilt position, the main controller 50 is switched from the neutral mode to the bow turning mode. This operation is shown in FIG. 5.

Figure 6:
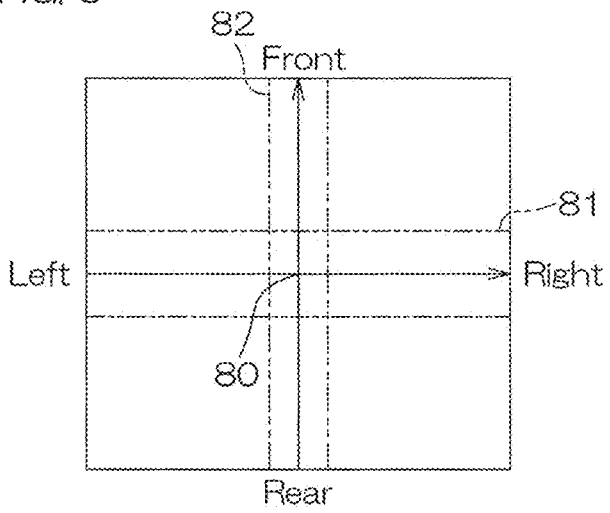
FIG. 6 is a diagram showing an anteroposterior insensitive zone and a lateral insensitive zone of a joystick.

Referring to FIG. 4, the main controller 50 is switched into the anteroposterior mode when the joystick 8 is operated anteroposteriorly in the neutral mode. The main controller 50 determines that the joystick 8 is operated anteroposteriorly if the anteroposterior component of the tilt amount of the joystick 8 from the neutral tilt position 80 (see FIG. 6) (hereinafter referred to simply as "tilt amount") falls outside a predetermined anteroposterior insensitive zone 81 (see FIG. 6). The main controller 50 determines that the joystick 8 is operated laterally if the lateral component of the tilt amount of the joystick 8 falls outside a lateral insensitive zone 82 (see FIG. 6).

In the anteroposterior mode, the main controller 50 causes the bow thruster BT to generate the propulsive force according to the lateral component of the tilt amount of the joystick 8. Further, the main controller 50 causes the outboard motor OM to generate the propulsive force according to the anteroposterior component of the tilt amount of the joystick 8. Further, the main controller 50 controls the steering angle of the outboard motor OM by controlling the steering actuator 25 according to the twisting of the joystick 8 to drive the steering mechanism 26.

More specifically, if the joystick 8 is tilted straight forward from the neutral tilt position, the main controller 50 controls the propulsive force of the bow thruster BT to zero, sets the shift position of the outboard motor OM to the forward shift position F, controls the magnitude of the propulsive force of the outboard motor OM according to the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction (twist direction) of the joystick 8. That is, the steering direction of the outboard motor OM corresponds to the twisting direction of the joystick 8, and the steering amount of the outboard motor OM corresponds to the twisting amount (twist amount) of the joystick 8. The twisting amount is a twisting amount from the neutral twist position of the joystick 8 (this definition also applies to the following description). The propulsive force of the bow thruster BT is kept at zero. Therefore, the user is able to adjust the steering of the outboard motor OM by the twisting of the joystick 8, while adjusting the propulsive force of the outboard motor OM by the forward tilt amount of the joystick 8.

If the joystick 8 is tilted in a diagonally forward-right direction, the main controller 50 causes the bow thruster BT to generate a rightward propulsive force, and controls the magnitude of the rightward propulsive force according to the lateral component of the tilt amount of the joystick 8. Further, the main controller 50 sets the shift position of the outboard motor OM to the forward shift position F, controls the magnitude of the propulsive force of the outboard motor OM according to the anteroposterior component of the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction of the joystick 8. That is, the steering direction of the outboard motor OM corresponds to the twisting direction of the joystick 8, and the steering amount of the outboard motor OM corresponds to the twisting amount of the joystick 8. The rightward propulsive force generated by the bow thruster BT applies a clockwise bow turning moment to the hull 2. Therefore, if the joystick 8 is twisted counterclockwise, the outboard motor OM is steered leftward with respect to its neutral steering position (a position at which the steering angle is zero), and the propulsive force of the outboard motor OM applies a counterclockwise bow turning moment to the hull 2. Therefore, the clockwise bow turning moment applied by the propulsive force of the bow thruster BT is reduced. Further, if the joystick 8 is twisted clockwise, the outboard motor OM is steered rightward with respect to the neutral steering position, and the propulsive force of the outboard motor OM applies a clockwise bow turning moment to the hull 2. Therefore, the clockwise bow turning moment is added to the clockwise bow turning moment applied by the propulsive force of the bow thruster BT. Thus, the user can move the hull 2 in the diagonally forward-right direction by the tilting of the joystick 8, and can adjust the bow turning of the hull 2 by the twisting of the joystick 8. For example, the user can find a twist position of the joystick 8 at which the hull 2 is free from the bow turning, while operating the joystick 8, to cause the hull 2 to translate in the diagonally forward-right direction.

If the joystick 8 is tilted in a diagonally forward-left direction, the main controller 50 causes the bow thruster BT to generate a leftward propulsive force, and controls the magnitude of the leftward propulsive force according to the lateral component of the tilt amount of the joystick 8. Further, the main controller 50 sets the shift position of the outboard motor OM to the forward shift position F, controls the magnitude of the propulsive force of the outboard motor OM according to the anteroposterior component of the tilt of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction of the joystick 8. That is, the steering direction of the outboard motor OM corresponds to the twisting direction of the joystick 8, and the steering amount of the outboard motor OM corresponds to the twisting amount of the joystick 8. The leftward propulsive force generated by the bow thruster BT applies a counterclockwise bow turning moment to the hull 2. Therefore, if the joystick 8 is twisted clockwise, the outboard motor OM is steered rightward with respect to the neutral steering position, and the propulsive force of the outboard motor OM applies a clockwise bow turning moment to the hull 2. Therefore, the counterclockwise bow turning moment applied by the propulsive force of the bow thruster BT is reduced. Further, if the joystick 8 is twisted counterclockwise, the outboard motor OM is steered leftward with respect to the neutral steering position, and the propulsive force of the outboard motor OM applies a counterclockwise bow turning moment to the hull 2. Therefore, the counterclockwise bow turning moment is added to the counterclockwise bow turning moment applied by the propulsive force of the bow thruster BT. Thus, the user is able to move the hull 2 in the diagonally forward-left direction by the tilting of the joystick 8, and is able to adjust the bow turning of the hull 2 by the twisting of the joystick 8. For example, the user is able to find a twist position of the joystick 8 at which the hull 2 is free from the bow turning, while operating the joystick 8, to cause the hull 2 to translate in the diagonally forward-left direction.

If the joystick 8 is tilted straight rearward from the neutral tilt position, the main controller 50 controls the propulsive force of the bow thruster BT to zero, sets the shift position of the outboard motor OM to the reverse shift position R, controls the magnitude of the propulsive force of the outboard motor OM according to the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction of the joystick 8. That is, the steering direction of the outboard motor OM corresponds to a direction opposite to the twisting direction of the joystick 8, and the steering amount of the outboard motor OM corresponds to the twisting amount of the joystick 8. The propulsive force of the bow thruster BT is kept at zero. Thus, the user is able to adjust the steering of the outboard motor OM by the twisting of the joystick 8 while adjusting the propulsive force of the outboard motor OM by the rearward tilt amount of the joystick 8.

If the joystick 8 is tilted in a diagonally rearward-right direction, the main controller 50 causes the bow thruster BT to generate a rightward propulsive force, and controls the magnitude of the rightward propulsive force according to the lateral component of the tilt amount of the joystick 8. Further, the main controller 50 sets the shift position of the outboard motor OM to the reverse shift position R, controls the magnitude of the propulsive force of the outboard motor OM according to the anteroposterior component of the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction of the joystick 8. That is, the steering direction of the outboard motor OM corresponds to a direction opposite to the twisting direction of the joystick 8, and the steering amount of the outboard motor OM corresponds to the twisting amount of the joystick 8. The rightward propulsive force generated by the bow thruster BT applies a clockwise bow turning moment to the hull 2. Therefore, if the joystick 8 is twisted counterclockwise, the outboard motor OM is steered rightward with respect to the neutral steering position, and the propulsive force of the outboard motor OM applies a counterclockwise bow turning moment to the hull 2. Therefore, the clockwise bow turning moment applied by the propulsive force of the bow thruster BT is reduced. Further, if the joystick 8 is twisted clockwise, the outboard motor OM is steered leftward, and the propulsive force of the outboard motor OM applies a clockwise bow turning moment to the hull 2. Therefore, the clockwise bow turning moment is added to the clockwise bow turning moment applied by the propulsive force of the bow thruster BT. Thus, the user is able to move the hull 2 in the diagonally rearward-right direction by the tilting of the joystick 8, and is able to adjust the bow turning of the hull 2 by the twisting of the joystick 8. For example, the user is able to find a twist position of the joystick 8 at which the hull 2 is free from the bow turning, while operating the joystick 8, to cause the hull 2 to translate in the diagonally rearward-right direction.

If the joystick 8 is tilted in a diagonally rearward-left direction, the main controller 50 causes the bow thruster BT to generate a leftward propulsive force, and controls the magnitude of the leftward propulsive force according to the lateral component of the tilt amount of the joystick 8. Further, the main controller 50 sets the shift position of the outboard motor OM to the reverse shift position R, controls the magnitude of the propulsive force of the outboard motor OM according to the anteroposterior component of the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction of the joystick 8. That is, the steering direction of the outboard motor OM corresponds to a direction opposite to the twisting direction of the joystick 8, and the steering amount of the outboard motor OM corresponds to the twisting amount of the joystick 8. The leftward propulsive force generated by the bow thruster BT applies a counterclockwise bow turning moment to the hull 2. Therefore, if the joystick 8 is twisted clockwise, the outboard motor OM is steered leftward with respect to the neutral steering position, and the propulsive force of the outboard motor OM applies a clockwise bow turning moment to the hull 2. Therefore, the counterclockwise bow turning moment applied by the propulsive force of the bow thruster BT is reduced. Further, if the joystick 8 is twisted counterclockwise, the outboard motor OM is steered rightward with respect to the neutral steering position, and the propulsive force of the outboard motor OM applies a counterclockwise bow turning moment to the hull 2. Therefore, the counterclockwise bow turning moment is added to the counterclockwise bow turning moment applied by the propulsive force of the bow thruster BT. Thus, the user is able to move the hull 2 in the diagonally rearward-left direction by the tilting of the joystick 8, and can adjust the bow turning of the hull 2 by the twisting of the joystick 8. For example, the user is able to find a twist position of the joystick 8 at which the hull 2 is free from the bow turning, while operating the joystick 8, to cause the hull 2 to translate in the diagonally rearward-left direction.

It is noted that, even if the anteroposterior component of the tilt amount of the joystick 8 falls within the anteroposterior insensitive zone 81 (see FIG. 6) when the lateral component of the tilt amount of the joystick 8 falls outside the lateral insensitive zone 82 (see FIG. 6) in the anteroposterior mode, the main controller 50 is maintained in the anteroposterior mode. This feature is not illustrated in FIG. 4 to avoid complication.

Even if the lateral component of the tilt amount of the joystick 8 falls outside the lateral insensitive zone 82 (see FIG. 6) when the anteroposterior component of the tilt amount of the joystick 8 falls within the anteroposterior insensitive zone 81 (see FIG. 6), the main controller 50 is maintained in the neutral mode, and controls the propulsive forces of the bow thruster BT and the outboard motor OM to zero. That is, the bow thruster BT is not driven, and the shift position of the outboard motor OM is set to the neutral shift position N.

When the anteroposterior component of the tilt amount of the joystick 8 falls within the anteroposterior insensitive zone 81 (see FIG. 6) and the lateral component of the tilt amount of the joystick 8 falls within the lateral insensitive zone 82 (see FIG. 6), the main controller 50 determines that the joystick 8 is in the neutral tilt position. When the twisting amount of the joystick 8 falls within a predetermined twist insensitive zone, the main controller 50 determines that the joystick 8 is in the neutral twist position. When the joystick 8 is in the neutral tilt position and the neutral twist position, the main controller 50 is in the neutral mode. Even if the joystick 8 is tilted laterally from the neutral tilt position over the lateral insensitive zone 82 (see FIG. 6) when the anteroposterior component of the tilt amount of the joystick 8 falls within the anteroposterior insensitive zone 81 (see FIG. 6) in the neutral mode, the main controller 50 is maintained in the neutral mode.

Referring next to FIG. 5, the main controller 50 is switched to the bow turning mode when the joystick 8 is twisted in the neutral mode.

In the bow turning mode, the main controller 50 causes the bow thruster BT to generate a propulsive force according to the twisting of the joystick 8. Further, the main controller 50 steers the outboard motor OM according to the twisting of the joystick 8, and causes the outboard motor OM to generate a propulsive force according to the anteroposterior component of the tilt amount of the joystick 8.

More specifically, if the joystick 8 is twisted from the neutral twist position, the main controller 50 drives the bow thruster BT so as to promote the bow turning of the hull 2 in a direction corresponding to the twisting direction of the joystick 8. That is, if the joystick 8 is twisted clockwise from the neutral twist position, the main controller 50 causes the bow thruster BT to generate a rightward propulsive force, and controls the magnitude of the rightward propulsive force according to the twisting amount of the joystick 8 from the neutral twist position. Thus, a clockwise bow turning moment is applied to the hull 2. Further, if the joystick 8 is twisted counterclockwise from the neutral twist position, the main controller 50 causes the bow thruster BT to generate a leftward propulsive force, and controls the magnitude of the leftward propulsive force according to the twisting amount of the joystick 8 from the neutral twist position. Thus, a counterclockwise bow turning moment is applied to the hull 2. As long as the anteroposterior component of the tilt amount of the joystick 8 falls within the anteroposterior insensitive zone 81 (see FIG. 6), the main controller 50 sets the shift position of the outboard motor OM to the neutral shift position N so as to prevent the outboard motor OM from generating the propulsive force. Thus, a fixed-point bow turning behavior is achieved by utilizing the propulsive force of the bow thruster BT alone. In the bow turning mode, however, the main controller 50 may control the steering angle of the outboard motor OM according to the twisting of the joystick 8. This steering angle control may be performed in substantially the same manner as when the joystick 8 is tilted forward in the anteroposterior mode.

If the joystick 8 is twisted clockwise from the neutral twist position and, in this state, the joystick 8 is tilted straight forward, the main controller 50 sets the shift position of the outboard motor OM to the forward shift position F, and causes the outboard motor OM to generate a propulsive force having a magnitude corresponding to the anteroposterior component of the tilt amount of the joystick 8. At this time, the main controller 50 steers the outboard motor OM in a direction corresponding to the twisting of the joystick 8, i.e., steers the outboard motor OM rightward with respect to the neutral steering position. The steering amount of the outboard motor OM corresponds to the twisting amount of the joystick 8 from the neutral twist position. Thus, the propulsive force of the outboard motor OM, as well as the propulsive force of the bow thruster BT, applies a clockwise bow turning moment to the hull 2.

If the joystick 8 is twisted clockwise from the neutral twist position and, in this state, the joystick 8 is tilted straight rearward, on the other hand, the main controller 50 sets the shift position of the outboard motor OM to the reverse shift position R, and causes the outboard motor OM to generate a propulsive force having a magnitude corresponding to the anteroposterior component of the tilt amount of the joystick 8. At this time, the main controller 50 steers the outboard motor OM in a direction opposite to the twisting direction of the joystick 8, i.e., steers the outboard motor OM leftward with respect to the neutral steering position. The steering amount of the outboard motor OM corresponds to the twisting amount of the joystick 8 from the neutral twist position. Thus, the propulsive force of the outboard motor OM, as well as the propulsive force of the bow thruster BT, applies a clockwise bow turning moment to the hull 2.

If the joystick 8 is twisted counterclockwise from the neutral twist position and, in this state, the joystick 8 is tilted straight forward, the main controller 50 sets the shift position of the outboard motor OM to the forward shift position F, and causes the outboard motor OM to generate a propulsive force having a magnitude corresponding to the anteroposterior component of the tilt amount of the joystick 8. At this time, the main controller 50 steers the outboard motor OM in a direction corresponding to the twisting of the joystick 8, i.e., steers the outboard motor OM leftward with respect to the neutral steering position. The steering amount of the outboard motor OM corresponds to the twisting amount of the joystick 8 from the neutral twist position. Thus, the propulsive force of the outboard motor OM, as well as the propulsive force of the bow thruster BT, applies a counterclockwise bow turning moment to the hull 2.

If the joystick 8 is twisted counterclockwise from the neutral twist position and, in this state, the joystick 8 is tilted straight rearward, on the other hand, the main controller 50 sets the shift position of the outboard motor OM to the reverse shift position R, and causes the outboard motor OM to generate a propulsive force having a magnitude corresponding to the anteroposterior component of the tilt amount of the joystick 8. At this time, the main controller 50 steers the outboard motor OM in a direction opposite to the twisting direction of the joystick 8, i.e., steers the outboard motor OM rightward with respect to the neutral steering position. The steering amount of the outboard motor OM corresponds to the twisting amount of the joystick 8 from the neutral twist position. Thus, the propulsive force of the outboard motor OM, as well as the propulsive force of the bow thruster BT, applies a counterclockwise bow turning moment to the hull 2.

If the joystick 8 is tilted in any of the diagonal directions (i.e., in the forward-right direction, the rearward-right direction, the forward-left direction, or the rearward-left direction) in the bow turning mode, the main controller 50 is switched into the anteroposterior mode. In the bow turning mode, the steering control operation is performed on the outboard motor OM according to the twisting of the joystick 8 as in the anteroposterior mode. Therefore, even if the main controller 50 is switched into the anteroposterior mode from the bow turning mode, the continuity of the watercraft maneuvering feeling is not impaired.

Figure 7:
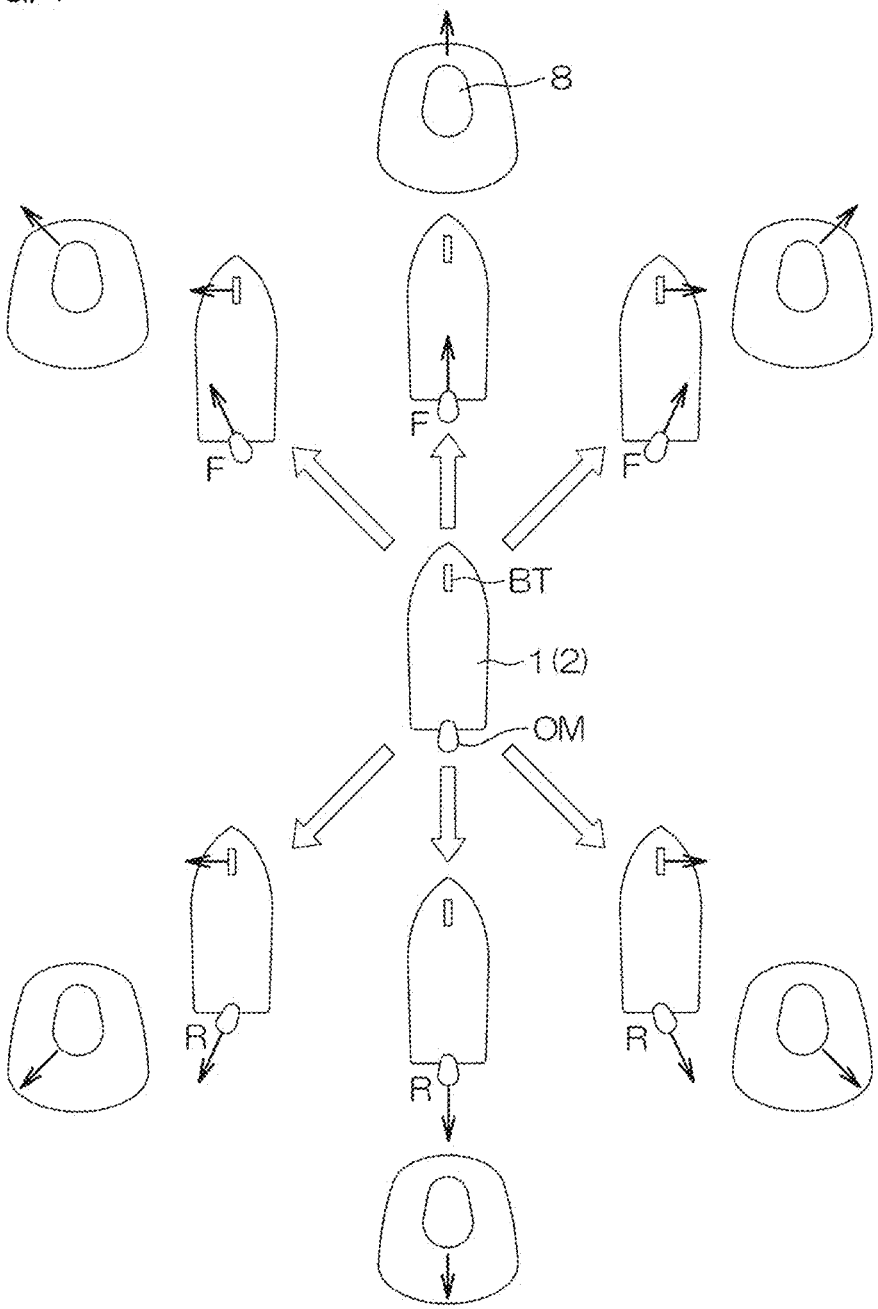
FIG. 7 is a diagram for describing a second joystick mode, showing the operation states of the joystick and the corresponding hull behaviors.

FIG. 7 is a diagram for describing a second joystick mode in the cooperative mode, showing the operation states of the joystick 8 and the corresponding behaviors of the hull 2. Either the first joystick mode described above or the second joystick mode to be described below is selectable, for example, by operating the input device 10. When the joystick mode is selected by operating the joystick button 181, the main controller 50 performs a process according to the first joystick mode or the second joystick mode selected by the operation of the input device 10.

In the second joystick mode, the main controller 50 regards the tilting of the joystick 8 as a translation command. Specifically, the main controller 50 regards the tilt direction of the joystick 8 as a traveling direction command indicating the traveling direction of the hull 2, and regards the tilt amount of the joystick 8 as a propulsive force magnitude command indicating the magnitude of the propulsive force to be applied in the traveling direction. Further, the main controller 50 regards the twisting (pivoting) of the joystick 8 about its axis as a bow turning command. Specifically, the main controller 50 regards the twisting direction of the joystick 8 about its axis (with respect to the neutral twist position) as a bow turning direction command, and regards the twisting amount of the joystick 8 (with respect to the neutral twist position) as a bow turning speed command. In order to follow these commands, the main controller 50 inputs a steering angle command and a propulsive force command to the remote control ECU 51, and inputs a propulsive force command to the motor controller 43 of the bow thruster BT.

The remote control ECU 51 transmits the steering angle command and the propulsive force command to the steering ECU 22 and the engine ECU 21, respectively, of the outboard motor OM. Thus, the outboard motor OM is steered to a steering angle indicated by the steering angle command, and the shift position and the engine speed of the outboard motor OM are controlled so as to generate a propulsive force indicated by the propulsive force command. Further, the motor controller 43 controls the rotation direction and the rotation speed of the electric motor 42 so as to generate a propulsive force having a direction and a magnitude indicated by the propulsive force command inputted thereto.

In the present example embodiment, the joystick 8 is an exemplary translation/bow turning operator to be operated by the user to issue commands for the translation and the bow turning of the hull 2.

When the joystick 8 is tilted without being twisted in the second joystick mode, the hull 2 is moved in a direction corresponding to the tilt direction of the joystick 8 without the bow turning, i.e., with its azimuth maintained. That is, the hull 2 is in a hull behavior of translation movement. Examples of the translation movement are shown in FIG. 7. A control mode of the main controller 50 in which the translation movement is achieved according to the operation (tilt operation) of the joystick 8 as shown in FIG. 7 is a so-called translation watercraft maneuvering mode.

The translation movement is achieved by moving the hull 2 in a state such that the bow turning moment applied to the hull 2 by the bow thruster BT and the bow turning moment applied to the hull 2 by the outboard motor OM cancel each other out (with the total bow turning moment kept at zero).

When the joystick 8 is tilted straight forward, the main controller 50 sets the shift position of the outboard motor OM to the forward shift position F, and controls the propulsive force of the bow thruster BT to zero. When the joystick 8 is tilted straight rearward, the main controller 50 sets the shift position of the outboard motor OM to the reverse shift position R, and controls the propulsive force of the bow thruster BT to zero. The propulsive force to be generated by the outboard motor OM is determined based on the tilt amount of the joystick 8. Thus, the hull 2 is caused to translate forward or rearward according to the operation of the joystick 8.

When the joystick 8 is tilted in the diagonally forward-right direction, the main controller 50 causes the bow thruster BT to generate a rightward propulsive force, and sets the shift position of the outboard motor OM to the forward shift position F. Further, the main controller 50 controls the steering angle of the outboard motor OM to steer the outboard motor OM leftward with respect to the neutral steering position (the position at which the steering angle is zero). Then, the propulsive force of the bow thruster BT applies a clockwise bow turning moment to the hull 2, and the propulsive force of the outboard motor OM applies a counterclockwise bow turning moment to the hull 2. Therefore, the clockwise bow turning moment and the counterclockwise bow turning moment cancel each other out, thus causing the hull 2 to translate in the diagonally forward-right direction. The propulsive force of the outboard motor OM is determined based on the tilt amount of the joystick 8, and the output of the bow thruster BT is determined by multiplying the lateral component of the propulsive force of the outboard motor OM by a predetermined ratio.

When the joystick 8 is tilted in the diagonally forward-left direction, the main controller 50 causes the bow thruster BT to generate a leftward propulsive force, and sets the shift position of the outboard motor OM to the forward shift position F. Further, the main controller 50 controls the steering angle of the outboard motor OM to steer the outboard motor OM rightward with respect to the neutral steering position (the position at which the steering angle is zero). Then, the propulsive force of the bow thruster BT applies a counterclockwise bow turning moment to the hull 2, and the propulsive force of the outboard motor OM applies a clockwise bow turning moment to the hull 2. Therefore, the counterclockwise bow turning moment and the clockwise bow turning moment cancel each other out, thus causing the hull 2 to translate in the diagonally forward-left direction. The propulsive force of the outboard motor OM is determined based on the tilt amount of the joystick 8, and the output of the bow thruster BT is determined by multiplying the lateral component of the propulsive force of the outboard motor OM by a predetermined ratio.

When the joystick 8 is tilted in the diagonally rearward-right direction, the main controller 50 causes the bow thruster BT to generate a rightward propulsive force, and sets the shift position of the outboard motor OM to the reverse shift position R. Further, the main controller 50 controls the steering angle of the outboard motor OM to steer the outboard motor OM rightward with respect to the neutral steering position (the position at which the steering angle is zero). Then, the propulsive force of the bow thruster BT applies a clockwise bow turning moment to the hull 2, and the propulsive force of the outboard motor OM applies a counterclockwise bow turning moment to the hull 2. Therefore, the clockwise bow turning moment and the counterclockwise bow turning moment cancel each other out, thus causing the hull 2 to translate in the diagonally rearward-right direction. The propulsive force of the outboard motor OM is determined based on the tilt amount of the joystick 8, and the output of the bow thruster BT is determined by multiplying the lateral component of the propulsive force of the outboard motor OM by a predetermined ratio.

When the joystick 8 is tilted in the diagonally rearward-left direction, the main controller 50 causes the bow thruster BT to generate a leftward propulsive force, and sets the shift position of the outboard motor OM to the reverse shift position R. Further, the main controller 50 controls the steering angle of the outboard motor OM to steer the outboard motor OM leftward with respect to the neutral steering position (the position at which the steering angle is zero). Then, the propulsive force of the bow thruster BT applies a counterclockwise bow turning moment to the hull 2, and the propulsive force of the outboard motor OM applies a clockwise bow turning moment to the hull 2. Therefore, the counterclockwise bow turning moment and the clockwise bow turning moment cancel each other out, thus causing the hull 2 to translate in the diagonally rearward-left direction. The propulsive force of the outboard motor OM is determined based on the tilt amount of the joystick 8, and the output of the bow thruster BT is determined by multiplying the lateral component of the propulsive force of the outboard motor OM by a predetermined ratio.

Since the steering angle of the outboard motor OM is less than 90 degrees (e.g., about 30 degrees) leftward and rightward, it is impossible to direct the resultant propulsive force of the single outboard motor OM and the bow thruster BT exactly laterally of the hull 2 (in a horizontal direction orthogonal to the center line 2*a* of the hull 2, or rightward or leftward of the hull 2). In the present example embodiment, therefore, the main controller 50 is designed so as not to respond to the exactly lateral operation of the joystick 8. In this aspect, the second joystick mode is the same as the first joystick mode. However, the hull 2 is moved substantially laterally rightward in a zig-zag traveling pattern by alternately repeating the translation movement in the diagonally forward-right direction and the translation movement in the diagonally rearward-right direction. Likewise, the hull 2 is moved substantially laterally leftward in a zig-zag traveling pattern by alternately repeating the translation movement in the diagonally forward-left direction and the translation movement in the diagonally rearward-left direction.

The following control parameters are preliminarily stored in the memory 50*b* of the main controller 50 for proper thrust allocation for the translation movement.

Control Parameters for Diagonally Forward-Right Translation

- A ratio between an outboard motor lateral thrust and a bow thruster output for the diagonally forward-right translation
- A maximum outboard motor thrust value for the diagonally forward-right translation
- A steering angle for the diagonally forward-right translation Control Parameters for Diagonally Forward-Left Translation

- A ratio between an outboard motor lateral thrust and a bow thruster output for the diagonally forward-left translation
- A maximum outboard motor thrust value for the diagonally forward-left translation
- A steering angle for the diagonally forward-left translation Control Parameters for Diagonally Rearward-Right Translation

- A ratio between an outboard motor lateral thrust and a bow thruster output for the diagonally rearward-right translation
- A maximum outboard motor thrust value for the diagonally rearward-right translation
- A steering angle for the diagonally rearward-right translation Control Parameters for Diagonally Rearward-Left Translation

- A ratio between an outboard motor lateral thrust and a bow thruster output for the diagonally rearward-left translation
- A maximum outboard motor thrust value for the diagonally rearward-left translation
- A steering angle for the diagonally rearward-left translation The main controller 50 determines the target propulsive force of the outboard motor OM according to the tilt amount of the joystick 8. Then, the main controller 50 determines the output (target output value) of the bow thruster BT by multiplying the lateral component of the target propulsive force (the outboard motor lateral thrust, corresponding to the lateral component of the tilt amount of the joystick 8) by the control parameter value of the ratio between the outboard motor lateral thrust and the bow thruster output. The control parameter "maximum outboard motor thrust value" indicates the upper limit value of the absolute value of a propulsive force permitted to be generated by the outboard motor OM, and the control parameter value of the maximum outboard motor thrust value is set so that the bow turning moment applied to the hull 2 by the outboard motor OM is cancelled out by the bow turning moment applied to the hull 2 by the bow thruster BT. The control parameter "steering angle" indicates the steering angle (target steering angle) of the outboard motor OM in the translation movement.

The control parameters may be each set to a default value (initial value) when the main controller 50 is shipped from a factory. However, the conditions for the translation movement vary depending on the individual watercraft 1, i.e., depending on the shape and the size of the hull 2, the type and the attachment position of the bow thruster BT, the type (model) and the attachment position of the outboard motor OM, the layout of other watercraft devices, loads and the like. Therefore, control parameter values (calibration values) are properly determined by performing calibration on the individual watercraft 1, and stored in the memory 50*b*.

Specifically, the calibration is herein performed to find control parameter values that make it possible to properly achieve the diagonally forward-right translation, the diagonally forward-left translation, the diagonally rearward-right translation, and the diagonally rearward-left translation of the hull 2, i.e., the diagonal translation movements of the hull 2 without the bow turning, and store the control parameter values as the calibration values in the memory 50*b*. The calibration thus performed makes it possible to achieve a translation movement as intended by the user according to the operation of the joystick 8. Typically, the diagonally forward-right translation, the diagonally forward-left translation, the diagonally rearward-right translation, and the diagonally rearward-left translation are individually calibrated such that the calibration values for the respective diagonal translations are generated and then stored in the memory 50*b* (see FIG. 2).

A calibration procedure and a calibration process to be performed by the main controller 50 will be described below by way of specific example. The diagonally forward-right translation, the diagonally forward-left translation, the diagonally rearward-right translation, and the diagonally rearward-left translation may be calibrated in any order. A procedure and a process to be performed to calibrate the diagonally forward-right translation, the diagonally forward-left translation, the diagonally rearward-right translation, and the diagonally rearward-left translation in this order will be described below.

Figure 8:
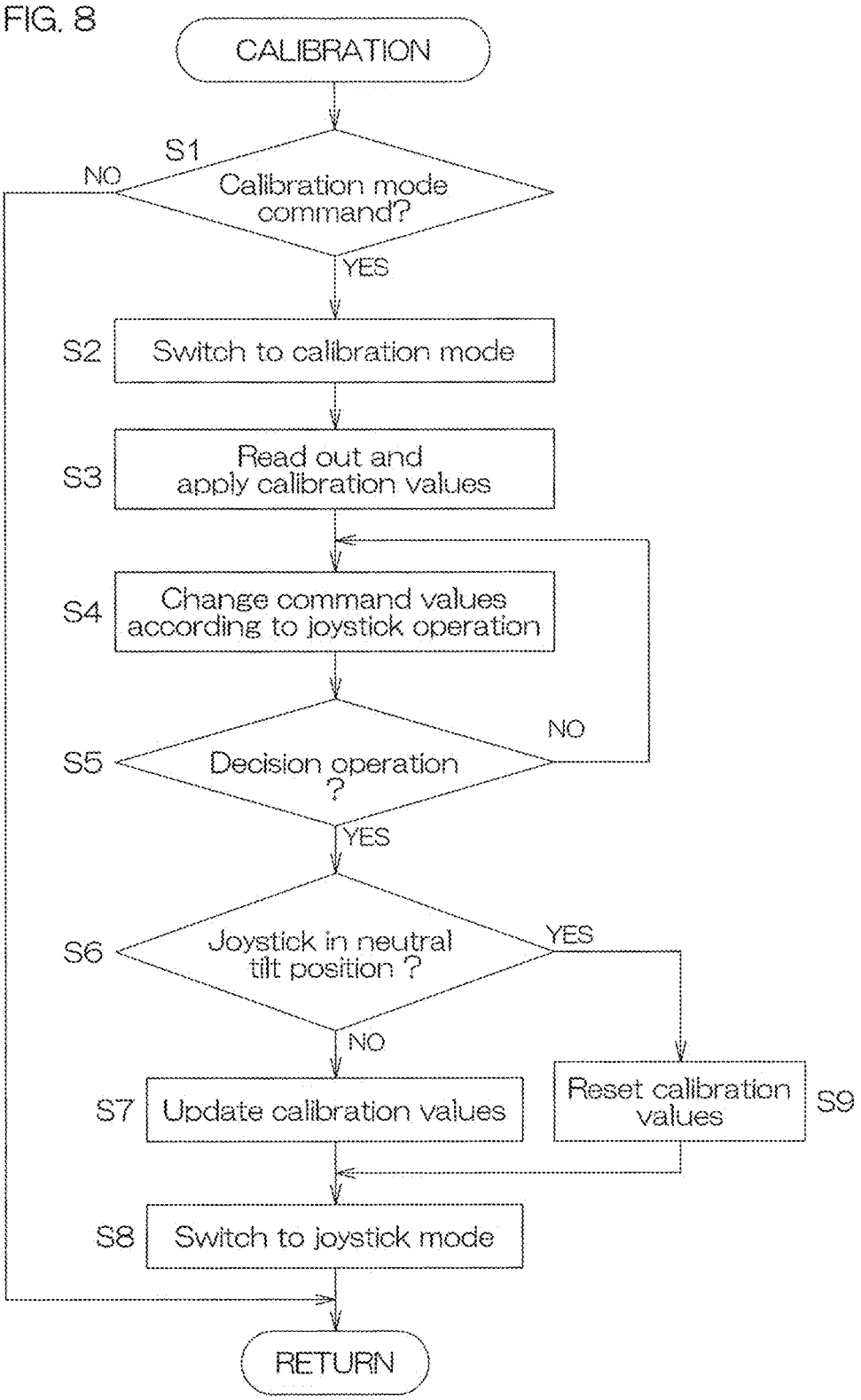
FIG. 8 is a flowchart showing an exemplary process to be performed by a main controller for diagonal translation calibration.

FIG. 8 is a flowchart showing an exemplary process to be performed for the diagonal translation calibration by the main controller 50.

The calibration is started when a calibrating person performs a predetermined calibration start operation to give a calibration mode command to the main controller 50. In this case, the calibrating person may be the user, or may be a worker of a boat builder, a dealer or the like. The calibration start operation may be, for example, the long-pressing of the joystick button 181. If the calibration start operation is performed (YES in Step S1), the control mode of the main controller 50 is switched into the calibration mode (Step S2). The calibrating person may be notified of the calibration mode by an indicator such as an LED lamp (not shown) provided in the joystick unit 18.

Upon the switching to the calibration mode, the main controller 50 reads out previously stored control parameter values (previous calibration values) from the memory 50*b* and, when the calibrating person operates the joystick 8, the main controller 50 generates a propulsive force command and a steering angle command by using the control parameter values thus read out (Step S3). If the calibration is performed for the first time, the control parameter values are default values preliminarily written in the memory 50*b*. Where the calibration is previously performed, the control parameter values are those set by the previous calibration. However, the control parameter values (calibration values) set by the previous calibration can be reset to the default values by a reset operation to be described later.

In the calibration mode, the calibrating person performs a diagonal translation operation for the calibration. Here, the calibrating person performs a diagonally forward-right translation operation, i.e., inclines the joystick 8 in the diagonally forward-right direction, by way of example. The calibrating person observes the behavior of the hull 2. If the bow of the hull 2 is turned counterclockwise, the calibrating person twists the joystick 8 clockwise for counteroperation in order to correct the counterclockwise bow turning. If the bow of the hull 2 is turned clockwise, the calibrating person twists the joystick 8 counterclockwise for counteroperation in order to correct the clockwise bow turning.

According to the operation of the joystick 8, a joystick operation signal is inputted to the main controller 50 from the joystick unit 18. According to the operation signal, the main controller 50 changes the propulsive force command for the bow thruster BT and the propulsive force command and the steering angle command for the outboard motor OM (Step S4). If the behavior of the hull 2 translating in the diagonally forward-right direction is achieved by the operation state of the joystick 8, the calibrating person performs a decision operation (YES in Step S5). The decision operation may be, for example, the pressing of the joystick button 181. In this case, the joystick button 181 is an example of the calibration ending operator.

In response to the decision operation, the main controller 50 determines whether or not the joystick 8 is in the neutral tilt position (Step S6). If the joystick 8 is not in the neutral tilt position, calibration values (proper control parameter values) for the diagonally forward-right translation are written and set in the memory 50*b* (Step S7). The calibration values written in the memory 50*b* are used when the main controller 50 thereafter computes the propulsive force command and the steering angle command according to the operation of the joystick 8 for the watercraft maneuvering with the use of the joystick 8. The calibration values for the diagonally forward-right translation are used for the computation of the propulsive force command and the steering angle command when the joystick 8 is tilted in the diagonally forward-right direction in the second joystick mode.

The main controller 50 computes the calibration values based on the control states of the bow thruster BT and the outboard motor OM observed when the decision operation is performed (Step S5), and writes the calibration values in the memory 50*b*. Specifically, a steering angle observed when the decision operation is performed is stored on an as-is basis as a calibration value in the memory 50*b*. Further, the main controller 50 computes a ratio between an outboard motor lateral thrust and a bow thruster output observed when the decision operation is performed, and stores the ratio as a calibration value in the memory 50*b*. Further, the main controller 50 computes a maximum outboard motor thrust value based on the ratio and the steering angle (stored as the calibration values) and the upper limit value of the output of the bow thruster BT, and stores the maximum outboard motor thrust value as a calibration value in the memory 50*b*. This calibration value corresponds to a propulsive force to be generated by the outboard motor OM to generate a bow turning moment to prevent the bow turning of the hull 2 against the bow turning moment generated by the propulsive force of the bow thruster BT when the output of the bow thruster BT is its upper limit value. Thereafter, the control mode is switched into the joystick mode (second joystick mode) (Step S8).

If the joystick 8 is in the neutral tilt position (YES in Step S6) when the decision operation (Step S5) is performed, the main controller 50 determines that the reset operation is performed so as to reset the calibration values to the default values. In this case, the main controller 50 resets the calibration values to the default values (Step S9). Subsequently, the control mode is switched into the joystick mode (second joystick mode) (Step S8).

Thereafter, the diagonally forward-left translation, the diagonally rearward-right translation and the diagonally rearward-left translation can be calibrated in substantially the same manner, and calibration values for the diagonally forward-left translation, calibration values for the diagonally rearward-right translation, and calibration values for the diagonally rearward-left translation are stored in the memory 50*b*.

The main controller 50 may write calibration status data in the memory 50*b*. The calibration status data indicates calibration statuses respectively indicating whether or not the diagonally forward-right translation is calibrated, whether or not the diagonally forward-left translation is calibrated, whether or not the diagonally rearward-right translation is calibrated, and whether or not the diagonally rearward-left translation is calibrated.

If any one of the diagonally forward-right translation, the diagonally forward-left translation, the diagonally rearward-right translation, and the diagonally rearward-left translation is calibrated, the main controller 50 sets the calibration status of the calibrated diagonal translation to a value indicating "calibrated."

The main controller 50 may estimate calibration values of the control parameters for the other uncalibrated diagonal translations (each having a calibration status "uncalibrated") based on the calibration values for the calibrated diagonal translation (having the calibration status "calibrated").

If the calibration values computed by the calibration of the diagonally forward-right translation are stored in the memory 50*b*, for example, the main controller 50 may estimate the calibration values for the diagonally forward-left translation, for the diagonally rearward-right translation, and for the diagonally rearward-left translation, and store the estimated calibration values in the memory 50*b*. In this case, the calibration statuses of the other diagonal translations for which the calibration values are estimated are each set to "uncalibrated." By calibrating at least one diagonal translation selected from the diagonally forward-right translation, the diagonally forward-left translation, the diagonally rearward-right translation, and the diagonally rearward-left translation, therefore, somewhat reasonable calibration values can be estimated for the other uncalibrated diagonal translations and stored in the memory 50*b*. Of course, the calibration values are more accurately computed and stored in the memory 50*b* by calibrating two or more of the four diagonal translations (preferably by calibrating all four diagonal translations).

Typically, the estimation of the calibration values are achieved based on lateral symmetry and anteroposterior symmetry. Specifically, it may be assumed that the calibration value of the ratio between the outboard motor lateral thrust and the bow thruster output for the diagonally forward-right translation is equal to that for the diagonally forward-left translation. Further, it may be assumed that calibration values obtained by inverting the positive/negative signs of the calibration values for the diagonally forward-right translation and for the diagonally forward-left translation are equal to those for the diagonally rearward-right translation and for the diagonally rearward-left translation, respectively. It may be assumed that the calibration value of the maximum outboard motor thrust value for the diagonally forward-right translation is equal to those for the diagonally forward-left translation, for the diagonally rearward-right translation, and for the diagonally rearward-left translation. It may be assumed that the calibration value of the steering angle for the diagonally forward-right translation is equal to that for the diagonally rearward-left translation. Further, it may be assumed that calibration values obtained by inverting the positive/negative signs of the calibration values for the diagonally forward-right translation and for the diagonally rearward-left translation are equal to those for the diagonally forward-left translation and for the diagonally rearward-right translation, respectively. Of course, the calibration values may be each estimated by correction with a proper correction factor.

Figure 9:
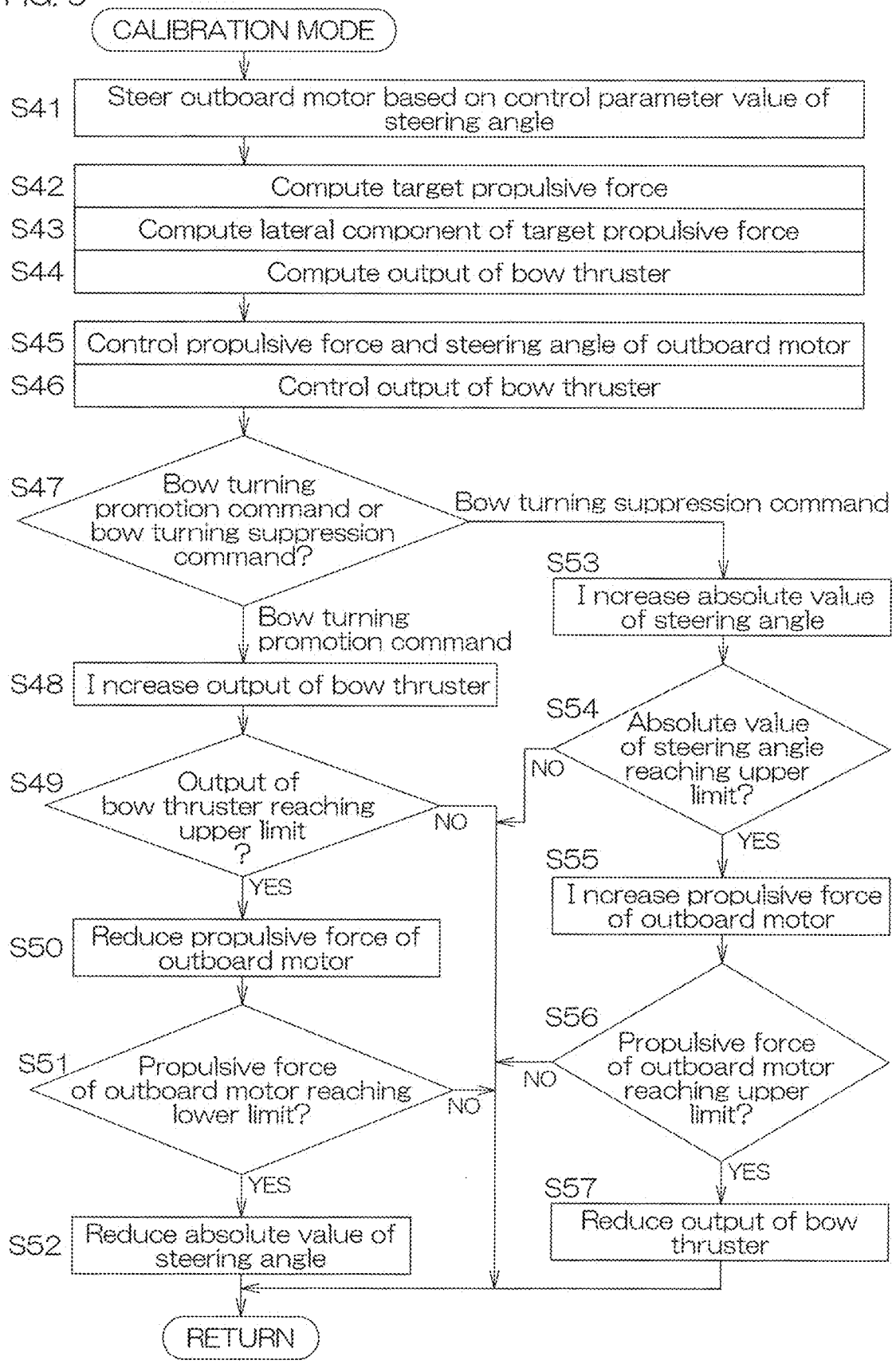
FIG. 9 is a flowchart showing an exemplary control process to be performed according to a translation command and a bow turning command in a calibration mode.

FIG. 9 is a flowchart showing an exemplary control process to be performed according to the translation command and the bow turning command in the calibration mode, and showing an exemplary operation to be performed in Step S4 of FIG. 8.

When the calibration mode is started, the calibrating person inclines the joystick 8 diagonally forward or diagonally rearward. Accordingly, the translation command is applied from the joystick unit 18 to the main controller 50. Then, the main controller 50 reads out the control parameter values (the previous calibration values or the default values) from the memory 50*b* according to the operation direction of the joystick 8 (the diagonally forward-right direction, the diagonally forward-left direction, the diagonally rearward-right direction, or the diagonally rearward-left direction), and controls the steering actuator 25 based on the control parameter value of the steering angle to steer the outboard motor OM (Step S41).

Further, the main controller 50 computes a target propulsive force to be generated by the outboard motor OM based on the tilt amount of the joystick 8 (Step S42). Further, the main controller 50 applies a propulsive force command indicating the shift position and the output of the outboard motor OM based on the target propulsive force to the outboard motor OM (Step S45). Further, the main controller 50 computes the lateral component of the target propulsive force based on the target propulsive force and the steering angle (Step S43). The main controller 50 computes the output of the bow thruster BT by multiplying the lateral component of the target propulsive force by the control parameter value of the ratio between the outboard motor lateral thrust and the bow thruster output (Step S44), and applies a propulsive force command indicating the bow thruster output to the bow thruster BT (Step S46).

Figure 10A:
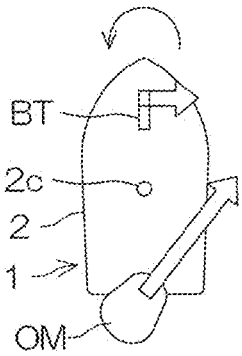
FIGS. 10A to 10D show an exemplary operation to be performed when a bow turning promotion command is issued in the calibration mode.
Figure 10B:
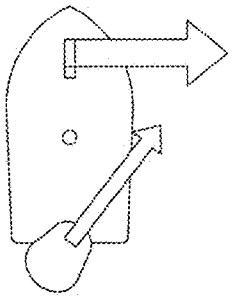

If the bow of the hull 2 is turned, the calibrating person twists the joystick 8 to suppress the bow turning. When the bow turning command applied by the twisting of the joystick 8 is a bow turning promotion command (a command that promotes or causes the bow turning of the hull 2 in the translation direction) indicating the bow turning of the hull 2 in a hull movement direction indicated by the translation command (Step S47), the main controller 50 increases the output of the bow thruster BT (Step S48). Specifically, if the bow of the hull 2 is turned counterclockwise as shown in FIG. 10A when a diagonally forward-right translation command is applied, the calibrating person twists the joystick 8 clockwise. Thus, as shown in FIG. 10B, the output of the bow thruster BT is increased to increase a rightward propulsive force to promote the clockwise bow turning of the hull 2. This correspondingly suppresses the counterclockwise bow turning of the hull 2. During this period, the steering angle of the outboard motor OM is not changed.

Figure 10C:
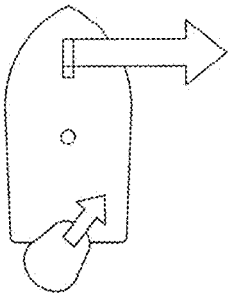
Figure 10D:
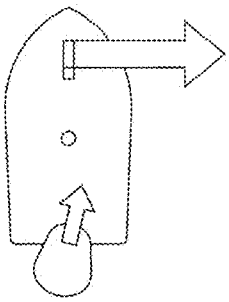

Even if the output of the bow thruster BT reaches its upper limit when the bow turning promotion command is applied (YES in Step S49), the main controller 50 reduces the propulsive force of the outboard motor OM while maintaining the steering angle of the outboard motor OM (Step S50, see FIG. 10C). Thereby, the bow turning moment applied to the hull 2 by the outboard motor OM is reduced. Even if the propulsive force of the outboard motor OM reaches a predetermined lower limit value when the bow turning promotion command is applied (YES in Step S51), the main controller 50 reduces the absolute value of the steering angle of the outboard motor OM (Step S52). That is, the steering angle of the outboard motor OM is changed so that the propulsive force direction of the outboard motor OM is moved toward the turning center 2*c* of the hull 2 (see FIG.

10D). During this period, the output of the bow thruster BT is maintained at its upper limit value, and the propulsive force of the outboard motor OM is maintained at its lower limit value.

Figure 11A:
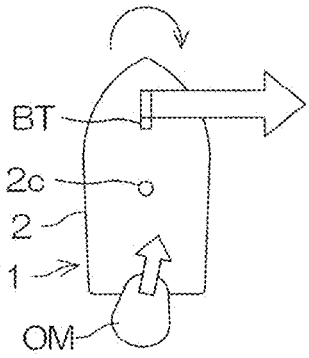
FIGS. 11A to 11D show an exemplary operation to be performed when a bow turning suppression command is issued in the calibration mode.
Figure 11B:
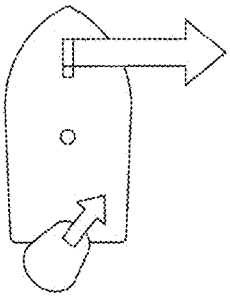

When the bow turning command applied by the twisting of the joystick 8 is a bow turning suppression command (a command that reduces or prevents the bow turning of the hull 2 in the translation direction) indicating the bow turning of the hull 2 in a direction opposite to the hull movement direction indicated by the translation command (Step S47), on the other hand, the main controller 50 increases the absolute value of the steering angle of the outboard motor OM (Step S53). Specifically, if the bow of the hull 2 is turned clockwise as shown in FIG. 11A when the diagonally forward-right translation command is applied, the calibrating person twists the joystick 8 counterclockwise. Thus, as shown in FIG. 11B, the main controller 50 changes the steering angle of the outboard motor OM so that the propulsive force direction of the outboard motor OM is moved away from the turning center 2*c*. This correspondingly increases the counterclockwise bow turning moment applied to the hull 2 by the outboard motor OM. Therefore, the counterclockwise bow turning of the hull 2 is promoted, and the clockwise bow turning of the hull 2 is correspondingly suppressed. During this period, the output of the bow thruster BT and the propulsive force of the outboard motor OM are not changed.

Figure 11C:
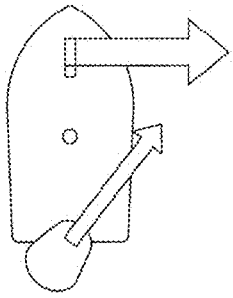
Figure 11D:
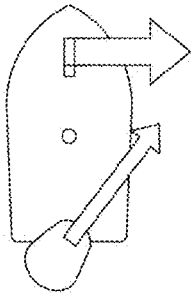

Even if the absolute value of the steering angle reaches its upper limit when the bow turning suppression command is applied (YES in Step S54), the main controller 50 increases the propulsive force of the outboard motor OM while maintaining the steering angle of the outboard motor OM (Step S55, see FIG. 11C). Thus, the bow turning moment applied to the hull 2 by the outboard motor OM is increased. Even if the propulsive force of the outboard motor OM reaches a predetermined upper limit value when the bow turning suppression command is applied (YES in Step S56), the main controller 50 reduces the output of the bow thruster BT (Step S57, see FIG. 11D). Thus, the bow turning moment applied to the hull 2 by the bow thruster BT is reduced. During this period, the absolute value of the steering angle of the outboard motor OM is maintained at its upper limit value, and the propulsive force of the outboard motor OM is maintained at its upper limit value.

For the bow turning promotion command applied by the twisting of the joystick 8, the output of the bow thruster BT, the propulsive force of the outboard motor OM, and the steering angle of the outboard motor OM are changed in this order. For the bow turning suppression command applied by the twisting of the joystick 8, the steering angle of the outboard motor OM, the propulsive force of the outboard motor OM, and the output of the bow thruster BT are changed in this order. Thus, a hull behavior such that the hull 2 is free from the bow turning is achieved. If a hull behavior intended by the calibrating person is not satisfactorily achieved by performing the calibration process once, the calibration process is repeatedly performed in the same manner such that the intended hull behavior is substantially achieved. Further, by placing importance on the adjustment of the output of the bow thruster BT for the bow turning promotion command and placing importance on the adjustment of the steering angle of the outboard motor OM for the bow turning suppression command, the absolute value of the steering angle of the outboard motor OM is increased as much as possible. Thus, the steering angle of the outboard motor OM for the diagonal translation is calibrated so as to efficiently utilize the lateral component of the propulsive force generated by the outboard motor OM, making it possible to promote the hull behavior during the diagonal translation.

In the second joystick mode, the main controller 50 controls the output of the bow thruster BT and the propulsive force and the steering angle of the outboard motor OM based on the calibration values if the translation command is applied from the joystick unit 18. When the bow turning command is applied from the joystick unit 18 by the twisting of the joystick 8, the main controller 50 changes one or both of the steering angle of the outboard motor OM and the output of the bow thruster BT to promote the bow turning of the hull 2 in a direction indicated by the bow turning command. This makes it possible to turn the bow of the hull 2 at a fixed point or to turn the bow of the hull 2 while moving the hull 2 diagonally.

In the present example embodiment, as described above, the watercraft propulsion system 100 is configured to perform the calibration for the diagonal movement command. For the bow turning promotion command issued during the calibration, the output of the bow thruster BT is first increased, and then the propulsive force of the outboard motor OM (an example of the propulsion device) is reduced. Therefore, the calibration is performed so as to increase the propulsive force of the outboard motor OM as much as possible. Thus, the overall propulsive force to be utilized for the diagonal movement is increased as much as possible.

Further, even if the propulsive force of the outboard motor OM reaches its lower limit when the bow turning promotion command is applied, then the absolute value of the steering angle of the outboard motor OM is reduced. Therefore, the calibration is performed so as to increase the absolute value of the steering angle of the outboard motor OM as much as possible. Thus, the lateral component of the propulsive force to be generated by the outboard motor OM is increased as much as possible. Therefore, the calibration is performed so that the overall propulsive force to be utilized for the diagonal movement is increased as much as possible.

For the bow turning suppression command issued during the calibration, on the other hand, the absolute value of the steering angle of the outboard motor OM is first increased, and then the propulsive force of the outboard motor OM is increased. Thereafter, the output of the bow thruster BT is reduced. Thus, the calibration is performed so as to increase the absolute value of the steering angle of the outboard motor OM as much as possible and to increase the propulsive force of the outboard motor OM as much as possible. Thus, the propulsive force of the outboard motor OM (particularly, the lateral component of the propulsive force of the outboard motor OM) is increased as much as possible. Therefore, the calibration is performed so that the overall propulsive force to be utilized for the diagonal movement is increased as much as possible.

In the present example embodiment, the calibration values include the calibration values for the diagonally forward-right movement command, the calibration values for the diagonally rearward-right movement command, the calibration values for the diagonally forward-left movement command, and the calibration values for the diagonally rearward-left movement command. Thus, these four sets of calibration values are respectively determined for the movements in the four diagonal directions such that the hull 2 is accurately moved in any of the diagonal directions as intended by the user.

Figure 12:
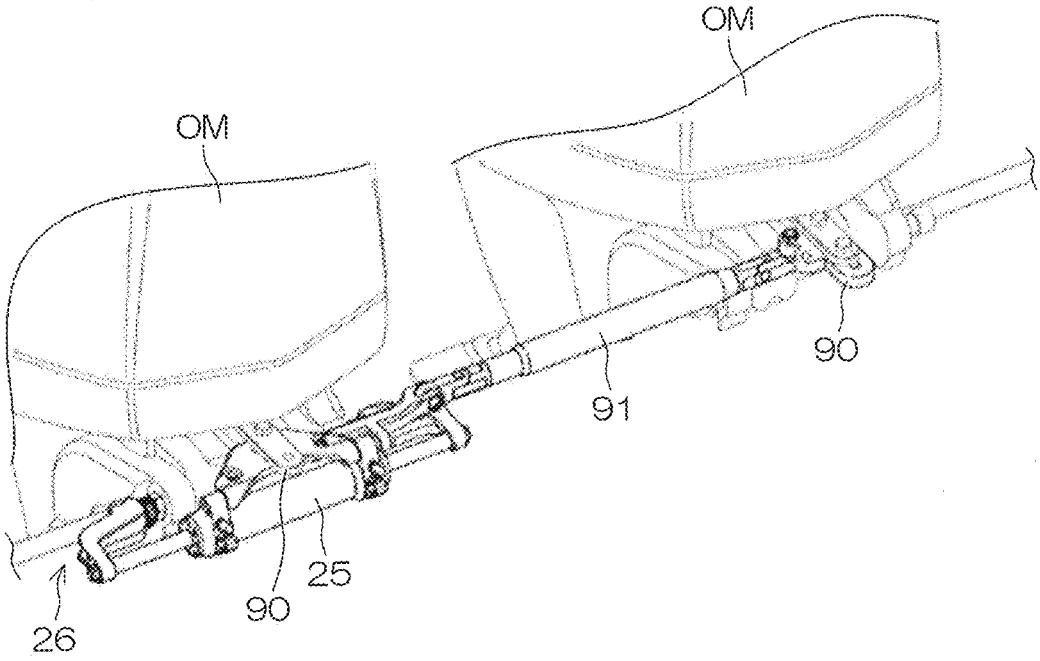
FIG. 12 is a diagram showing an arrangement of a watercraft propulsion system according to another example embodiment of the present invention.

FIG. 12 is a diagram showing an arrangement of a watercraft propulsion system according to another example embodiment of the present invention. In the example embodiment described above, the single propulsion device (single outboard motor OM) is provided on the stern of the hull 2 by way of example. Alternatively, the example embodiment described above may be applied to an arrangement which includes a plurality of propulsion devices provided on the stern of the hull 2 and configured to be steered at the same steering angle. In the example shown in FIG. 12, the steering levers 90 of the respective outboard motors OM provided on the stern are mechanically connected together by a link 91, and the outboard motors OM (in this example, two outboard motors OM) are steered in synchronism (i.e., at the same steering angle) by a single steering. In this example, the steering includes a steering actuator 25 and a steering mechanism 26 to be driven by the steering actuator 25.

The plurality of propulsion devices configured to be steered in synchronism at the same steering angle apply their propulsive forces in the same direction to the hull 2, but are not able to apply the propulsive forces simultaneously in different directions to the hull 2. In this aspect, a combination of the plurality of propulsion devices is equivalent to the single propulsion device. Therefore, the example embodiments described above are applicable to a watercraft propulsion system which includes a plurality of propulsion devices provided on the stern of a hull 2 and incapable of applying their propulsive forces simultaneously in different directions to the hull 2, and a bow thruster BT provided at the bow of the hull 2. Thus, the bow thruster BT, the propulsion devices, and the steering are properly actuated in proper response to the tilting and the twisting of the joystick 8 such that the hull behavior is achieved as intended by the user.

While the example embodiments of the present invention have thus been described, the present invention may be embodied in some other ways.

In the example embodiments described above, the bow thruster BT is fixed to the hull 2 in an unsteerable manner. Alternatively, a steerable propulsion unit such as a trolling motor may be used as the bow thruster BT. The example embodiments described above are applicable even in this case.

In the example embodiments described above, the outboard motor OM is used as the propulsion device by way of example, but the propulsion device may be in any of various types such as an inboard motor, an inboard/outboard motor, and a waterjet propulsion device. The propulsion device may be provided on a proper portion of the hull other than the stern.

In the example embodiments described above, the diagonal movement command is principally applied from the joystick unit 18 to the main controller 50 by way of example. Alternatively, the diagonal movement command may be internally generated by the main controller 50, for example, in the automatic watercraft maneuvering mode such as the position holding mode. Further, the diagonal movement command may be generated by an autopilot device provided separately from the main controller 50.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

a bow thruster at a bow of a hull to generate a propulsive force laterally of the hull;

a propulsion device on the hull to generate a propulsive force anteroposteriorly of the hull;

a steering to change a course of the hull; and a controller configured or programmed to control the bow thruster, the propulsion device, and the steering in response to a diagonal movement command to control an output of the bow thruster, the propulsive force generated by the propulsion device, and a steering angle of the steering; wherein the controller is configured or programmed to include a calibration mode in which a calibration value to be used to control the bow thruster, the propulsion device, and the steering according to the diagonal movement command is set, to increase the output of the bow thruster when a bow turning promotion command that causes bow turning in a movement direction indicated by the diagonal movement command is issued together with the diagonal movement command in the calibration mode, and to reduce the propulsive force of the propulsion device even if the output of the bow thruster reaches its upper limit when the bow turning promotion command is issued in the calibration mode.

2. The watercraft propulsion system according to claim 1, wherein the controller is configured or programmed to reduce an absolute value of the steering angle of the steering even if the propulsive force of the propulsion device is reduced to its lower limit when the bow turning promotion command is issued in the calibration mode.

3. The watercraft propulsion system according to claim 1, wherein the controller is configured or programmed to increase an absolute value of the steering angle of the steering when a bow turning suppression command that causes bow turning in a direction opposite to the movement direction indicated by the diagonal movement command is issued together with the diagonal movement command in the calibration mode, to increase the propulsive force of the propulsion device even if the absolute value of the steering angle reaches its upper limit when the bow turning suppression command is issued in the calibration mode, and to reduce the output of the bow thruster even if the propulsive force of the propulsion device reaches its upper limit when the bow turning suppression command is issued in the calibration mode.

4. The watercraft propulsion system according to claim 1, wherein the calibration value includes a calibration value of a ratio between a lateral component of the propulsive force of the propulsion device and the output of the bow thruster, and a calibration value of the steering angle of the steering.

5. The watercraft propulsion system according to claim 4, wherein the calibration value further includes a calibration value of a maximum value of the propulsive force generated by the propulsion device.

6. The watercraft propulsion system according to claim 1, wherein the calibration value includes calibration values for a diagonally forward-right movement command, a diagonally rearward-right movement command, a diagonally forward-left movement command, and a diagonally rearward-left movement command.

7. The watercraft propulsion system according to claim 6, wherein the controller is configured or programmed to set a calibration value for at least one of the diagonally forward-right movement command, the diagonally rearward-right movement command, the diagonally forward-left movement command, and the diagonally rearward-left movement command, and then compute calibration values yet to be set for the other diagonal movement commands based on the calibration value thus set.

8. The watercraft propulsion system according to claim 1, further comprising:

a calibration ending operator operable by a calibrating person to end the calibration mode; wherein the controller is configured or programmed to generate the calibration value based on control states of the bow thruster, the propulsion device, and the steering observed when the calibration ending operator is operated, and store the calibration value in a memory.

9. The watercraft propulsion system according to claim 1, wherein the propulsion device includes only one single propulsion device on a stern of the hull, or a plurality of propulsion devices on the stern of the hull and steerable at a same steering angle.

10. The watercraft propulsion system according to claim 1, wherein the bow thruster is fixed to the hull in an unsteerable manner.

11. A watercraft comprising:

a hull; and the watercraft propulsion system according to claim 1.

* * * * *